US009267287B1

(12) United States Patent
Bongiorno

(10) Patent No.: US 9,267,287 B1
(45) Date of Patent: Feb. 23, 2016

(54) PRE-FABRICATED THREADED BAR ASSEMBLIES

(71) Applicant: Steven James Bongiorno, Freeport, NY (US)

(72) Inventor: Steven James Bongiorno, Freeport, NY (US)

( * ) Notice: Subject to any disclaimer, the term of this patent is extended or adjusted under 35 U.S.C. 154(b) by 0 days.

(21) Appl. No.: 14/601,732

(22) Filed: Jan. 21, 2015

Related U.S. Application Data

(60) Provisional application No. 61/930,461, filed on Jan. 22, 2014, provisional application No. 61/992,254, filed on May 13, 2014, provisional application No. 62/066,945, filed on Oct. 22, 2014.

(51) Int. Cl.

| | |
|---|---|
| ***E04H 12/00*** | (2006.01) |
| ***E04C 5/06*** | (2006.01) |
| ***E04C 5/16*** | (2006.01) |
| ***E04G 21/14*** | (2006.01) |

(52) U.S. Cl.
CPC ..... *E04C 5/0622* (2013.01); *E04C 5/163* (2013.01); *E04G 21/142* (2013.01)

(58) Field of Classification Search
CPC ..... E04C 5/0604; E04C 5/0618; E04C 5/163; E04C 5/16; E04C 5/18; E04C 5/208; E04C 5/0622; E04G 21/142
USPC ..... 52/649.1, 649.3, 745.17, 849
See application file for complete search history.

(56) References Cited

U.S. PATENT DOCUMENTS

| | | | | | |
|---|---|---|---|---|---|
| 904,978 | A | * | 11/1908 | Miles | 52/687 |
| 1,008,209 | A | * | 11/1911 | Skinner | 52/649.4 |
| 1,008,210 | A | * | 11/1911 | Skinner | 52/260 |
| 1,079,829 | A | * | 11/1913 | Bennett | 52/372 |
| 1,096,685 | A | * | 5/1914 | Cummings | 52/649.4 |
| 1,318,405 | A | * | 10/1919 | Perrott | 52/677 |
| 1,485,811 | A | * | 3/1924 | Pederson | 52/649.4 |
| 1,817,437 | A | * | 8/1931 | Hawkinson | 249/83 |
| 1,911,957 | A | * | 5/1933 | Jacob | 52/687 |
| 3,245,190 | A | * | 4/1966 | Reiland | 52/649.3 |
| 3,367,084 | A | * | 2/1968 | Reiland | 52/649.7 |
| 3,473,285 | A | * | 10/1969 | Reiland | 52/745.17 |
| 3,604,180 | A | * | 9/1971 | Wood | 52/649.3 |
| 3,744,207 | A | * | 7/1973 | Oroschakoff | 52/664 |
| 3,957,087 | A | * | 5/1976 | Johnston | 138/178 |
| 4,362,423 | A | * | 12/1982 | Miles | 403/393 |
| 4,377,928 | A | * | 3/1983 | Hasak | 52/649.4 |
| 4,467,583 | A | * | 8/1984 | Hasak | 52/649.4 |
| 4,833,857 | A | * | 5/1989 | Wheeler | 52/687 |
| 5,392,580 | A | * | 2/1995 | Baumann | 52/660 |
| 5,927,346 | A | * | 7/1999 | Majnaric et al. | 138/175 |
| 6,293,071 | B1 | * | 9/2001 | Konstantinidis | 52/659 |

(Continued)

*Primary Examiner* — Basil Katcheves
*Assistant Examiner* — Joshua Ihezie
(74) *Attorney, Agent, or Firm* — Alfred M. Walker

(57) ABSTRACT

A pre-fabricated reinforcement cage is constructed of at least two cage frames spaced apart from each other. The cage frames include preferably axially extending steel plates and axially extending sleeves preferably having an internal threading pattern that is complimentary to the external threading pattern of a plurality of longitudinal reinforcing bars. The cage frames are optionally also provided with lifting bar guide collars to receive a lifting apparatus comprised of one or more lifting bars. The cage frame plates, sleeves and lifting bar guide collars are fastened together. The longitudinal reinforcing bars, having continuous, external thread-like deformations along their length are installed into the internally threaded sleeves or into threads of locking nuts holding the bars within optional smooth sleeves during the fabrication.

24 Claims, 26 Drawing Sheets

(56) References Cited

U.S. PATENT DOCUMENTS

| | | | | |
|---|---|---|---|---|
| 7,374,369 | B2 * | 5/2008 | Jakubowski et al. | 405/244 |
| 7,421,827 | B1 * | 9/2008 | Konstantinidis | 52/698 |
| 8,375,678 | B1 * | 2/2013 | Ferrer | 52/745.17 |
| 8,381,479 | B1 | 2/2013 | Ferrer | |
| 8,387,329 | B2 * | 3/2013 | Stevens et al. | 52/649.8 |
| 8,505,267 | B2 * | 8/2013 | Martin Hernandez | 52/749.11 |
| 8,973,317 | B2 * | 3/2015 | Larkin | 52/223.14 |
| 2008/0028718 | A1 * | 2/2008 | Erickson et al. | 52/687 |
| 2008/0072414 | A1 * | 3/2008 | Buley | 29/527.1 |
| 2008/0209843 | A1 * | 9/2008 | Helms | 52/677 |
| 2009/0100784 | A1 * | 4/2009 | Garza et al. | 52/686 |
| 2009/0145074 | A1 * | 6/2009 | Tsukamoto | 52/686 |

* cited by examiner

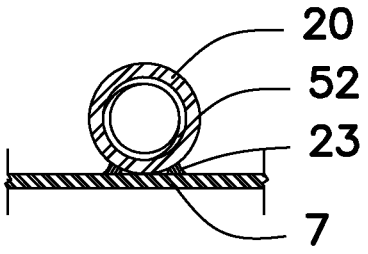
FIG. 6A
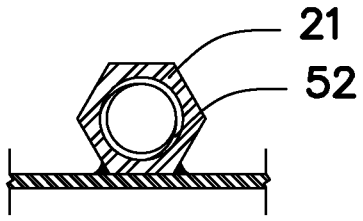
FIG. 6A1
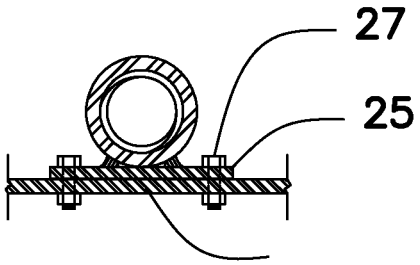
FIG. 6B
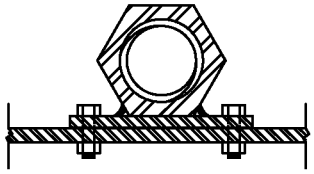
FIG. 6B1
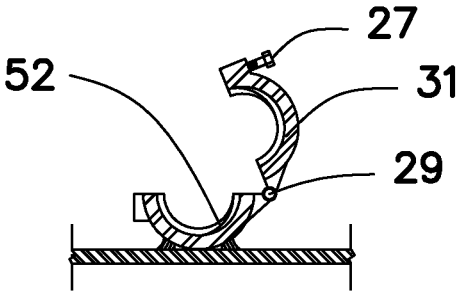
FIG. 6C
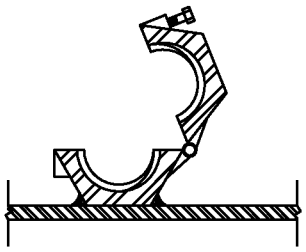
FIG. 6C1

PRE-FABRICATED THREADED BAR ASSEMBLIES

RELATED APPLICATIONS

This application is based upon provisional patent application 61/930,461 filed Jan. 22, 2014, provisional patent application 61/992,254 filed May 13, 2014 and provisional patent application 62/066,945 filed Oct. 22, 2014, and claims priority under 35 USC §119 (e) therefrom. These applications are incorporated by reference herein.

FIELD OF THE INVENTION

The present invention relates to making and installing pre-fabricated assemblies of threaded bars for intimate contact with aggregate structural material, such as concrete.

BACKGROUND OF THE INVENTION

The present invention relates to building construction technologies. In particular, the present invention relates to the fabrication and installation of reinforcing bars for members of concrete structures, such as columns and walls, among other things. The present invention provides a method and apparatus for the safe, efficient and economical pre-fabrication and erection of assemblies of reinforcing bars used in the construction of concrete structures.

In multi-level concrete construction, it is a common practice to place longitudinal steel reinforcement rods individually. Pre-fabrication of assemblies of longitudinal reinforcing bars is sometimes employed to limit the on-site labor associated with the placement of individual bars. These assemblies generally utilize wire ties or other common bar ties to form an assembly, or module, of typically four or more reinforcing bars. Such assemblies are also often provided with some or all of the transverse reinforcement installed.

Recent advances in concrete reinforcement technology have led to the increased use of threaded reinforcing bars. So-called threadbar reinforcement has continuous thread-like deformations along the length of the bar, and are typically provided with compatible hardware with complimentary internal threading, such as nuts, couplers, anchors, etc. Threadbar reinforcement has been used for many decades and is available from domestic and international suppliers such as Dywidag Systems International, Williams Form Engineering and SAS Stressteel, to name a few.

Threaded reinforcing bars are typically connected with internally threaded couplers. Coupling of the bars generally requires rotating, or spinning, of the couplers along the bars, as well as rotating, or torquing, one or both of the so connected bars for full engagement of the coupler. This requires that one or both of the threaded bars being connected be free to rotate. The use of conventional prefabricated cages, or modules, is generally not suited for this purpose, because in creating a rigid cage for installation, the free rotation of the bars is typically impeded. This represents a significant disadvantage of conventional prefabrication techniques. Another disadvantage of conventional pre-fabricated reinforcement cages is that during their installation the rigging is attached to the permanent cage at the top, thus requiring a worker to climb up the cage to release the hoisting leads.

Alternatively, the prior art patents of Ferrer (U.S. Pat. No. 8,375,678) and Ferrer (U.S. Pat. No. 8,381,479) teach a method and apparatus for the prefabrication of modular reinforcement cages for concrete structures, wherein longitudinal threaded reinforcing bars are held in formation by a set of flat, two dimensional templates with apertures cut at the location and corresponding diameter to the reinforcing bars that are subsequently charged through the apertures. The flat planar templates of Ferrer '678 and Ferrer '479 are provided perpendicular to the axis of the reinforced bars, impeding aggregate material concrete flow therethrough. The apertures are provided with enough clearance from the reinforcing bars to permit free movement of the bars with respect to the template. The reinforcing bars are then locked in place against the template by use of opposing internally threaded lock nuts. Standard set screws are then installed into the lock nuts to provide a temporary locking mechanism to prevent inadvertent rotation, or spinning, of lock nuts during fabrication, transportation and erection. Such locking mechanisms must obviously be removed in order to rotate the bars. The use of internally threaded lock nuts is intended to permit the free rotation of the threaded reinforcing bars through the template and lock nuts, thus allowing the bars to be rotated in the field during installation. The flat, two dimensional templates of Ferrer '678 and Ferrer '479 are intended to provide accurate spatial relation of the longitudinal bars, as well as rigidity for the module when being lifted.

Although the prior art patents of Ferrer '678 and Ferrer '479 are intended to overcome one of the primary disadvantages of conventional pre-fabricated reinforcement cages, they possess certain additional shortcoming and disadvantages, including, but not necessarily limited to:

1. The flat, two dimensional template of Ferrer '678 and '479 occupies a significant sectional area of the concrete element being reinforced, and thus impedes the flow of concrete during placement.
2. The template of Ferrer '678 and '479 occupies a significant sectional area of the concrete element being reinforced and thus also results in a significant discontinuity in the transmission of stress between the concrete on opposite sides of the flat, two dimensional template. This significant discontinuity also facilitates the development of undesirable shrinkage cracks in the concrete.
3. The perpendicular weak-axis orientation of the flat, two dimensional template of Ferrer '678 and '479 with respect to the longitudinal direction of the reinforcement requires a substantial quantity of material to achieve any significant strength and stiffness of the cage.

Objects of the Present Invention

There is a need for a safe, efficient and economical means of fabricating and erecting reinforcement assemblies using threaded reinforcing bars that overcomes the limitations, shortcomings and disadvantages of the prior art. The present invention overcomes these limitations, shortcomings and disadvantages.

Other objects will become apparent from the following description of the present invention.

SUMMARY OF THE INVENTION

In keeping with these objects and others which may become apparent, the three dimensional (3D) prefabricated assemblies of threaded bars of the present invention are provided for intimate contact with poured concrete or other aggregate material, wherein the reinforced bars are held in place by cage frames with axially extending frame plates having axially extending threaded sleeves, with minimal interference with the concrete poured from above.

The pre-fabricated reinforcement cages of the present invention are constructed of at least two cage frames spaced apart from each other holding a plurality of longitudinally extending, axially parallel, reinforcing bars over which concrete aggregate material is poured in intimate contact. The cage frames are preferably made of axially extending steel plates and aligned extending longitudinal internally threaded sleeves which extend axially parallel to the parallel axes of the respective reinforcing bars. Preferably the internally threaded sleeves have an internal threading pattern that is complimentary to the external threading pattern of the horizontally or vertically extending longitudinal reinforcing bars. The cage frames are also optionally provided with a means for installing a lifting apparatus, such as lifting bar guide collars, to lift the prefabricated three dimensional assemblies in place prior to pouring of concrete aggregate material in intimate contact with the reinforced bars.

The locations of the internal threading along the longitudinal axis of the internally threaded sleeves are preferably aligned with those of adjacent internally threaded sleeves, to minimize binding between the reinforcing bars and the sleeves during installation of the reinforcing bars into the sleeves.

While the cage frames are preferably a plurality of axially extending plates forming a rectangle, it is known to those skilled in the art that the axially extending plates may have other geometric configurations, such as having circular, oval, square or other polygonal crossectional shapes. In the case of cylindrical or oval shaped cage frames, at least one axially aligned plate forms a complete circle or oval in crossection, wherein said at least one circular or oval plate of said cage frames extends parallel to the axes of the plurality of reinforcing bars. In the case of rectangular, square or polygonal shaped cage frames, there are a plurality of axially aligned plates connected edgewise to each other by common joints, forming square, rectangular or other polygonal shaped cage frames, wherein said plates of said cage frames extend parallel to the axes of the plurality of reinforcing bars.

The longitudinal reinforcing bars have continuous thread-like deformations along their exterior length, so that they can be installed into the internally threaded sleeves during the fabrication.

For definition purposes, in connection with the words "axially extending" with respect to the directional positioning of the cage frame plates of the cage frame, the term "axially extending" means "vertically extending" if the axis of the reinforcing bars is vertical in installation before pouring of concrete. Likewise, the term "axially extending" means "horizontally extending" if the axis of the reinforcing bars are horizontal in installation before pouring of concrete.

Each three dimensional cage frame functions as a rigid structural frame defining the dimensions of the pre-fabricated reinforcement cage and the locations of the longitudinal reinforcing bars, while providing great strength and rigidity to the pre-fabricated reinforcement cage. The dimensions of the pre-fabricated reinforcement cage and the quantity and locations and of the internally threaded sleeves and longitudinal reinforcing bars is determined by design. The spatial geometry of the cage frame, the thickness of cage frame plates and internally threaded sleeves, as well as the welds and fasteners, as the case may be, are also determined by design, based upon the weight of the pre-fabricated reinforcement cage and the transportation and erection forces, among other things.

Preferably, where the pre-fabricated reinforcement cage is installed in a vertical, or substantially vertical, orientation, the pre-fabricated reinforcement cage is provided with lifting apparatus, such as at least one, and preferably two, lifting bars inserted through the lifting bar guide collars on the cage frame. The lifting bars are comprised preferably of steel bars with external threading at one end to accept a fastener, such as a nut having complimentary internal threading. The nut is preferably provided with a temporary holding means comprised preferably of a spring clamp, but alternatively may be provided with a standard set screw. The opposite end of the lifting bar is provided with a preferably cylindrical steel lifting collar onto which a preferably steel lifting ring, or hook eye, is attached, either directly or with the use of sleeves and bearing plates, to prevent movement of the lifting bars.

The aforementioned lifting apparatus may be adapted for use with other prefabricated bar assemblies, such as conventionally used bar cages and that of Ferrer '678 and Ferrer '479.

Reinforcement members, such as beam stirrups, column ties and wall ties are installed around erection wires for prefabrication of the reinforcement cages.

The pre-fabricated reinforcement cage may be constructed in a shop or at the site by first assembling the three dimensional cage frames and setting them into position with the use of gigs, bracing and other fabrication aids utilized in common practice.

The longitudinal reinforcing bars are installed with mechanical rotating tools into the thus assembled three dimensional cage frames, preferably by rotating the bars through the respective internally threaded sleeves of the three dimensional cage frames to the desired position along the length of the pre-fabricated reinforcement cage.

At any time before, during or after installation of the longitudinal reinforcing bars to their intended position in the pre-fabricated reinforcement cage, the lifting bars are installed through the lifting bar guide collars to their intended position in the pre-fabricated reinforcement cage, and fastened in place, preferably with temporary holding means such as clamps, to prevent movement of the lifting bar through the lifting bar collar.

After the longitudinal reinforcing bars are installed to their intended position in the pre-fabricated reinforcement cage, temporary holding means, such as a spring clamp, may be installed on opposite sides of the internally threaded sleeves to prevent unintended rotation of the longitudinal reinforcing bars (3) relative to the threaded sleeves.

After the pre-fabricated reinforcement cage(s) are constructed, they are transported to the construction site. Where the pre-fabricated reinforcement cage will be installed in a vertical or substantially vertical orientation, the hoisting rigging is attached to the lifting collars of the lifting bars. For horizontal, or substantially horizontal applications, the pre-fabricated reinforcement cage(s) can be rigged in a typical manner. The pre-fabricated reinforcement cage(s) are then lifted to their intended locations and in alignment with any adjacent reinforcement to which it is intended to be connected. Prior to making such connection, any temporary holding means installed during the fabrication are to be removed, thus allowing the longitudinal reinforcing bars to rotate freely within the internally threaded sleeves. The longitudinal reinforcing bars may then be connected, or coupled, together my typical methods. Once a sufficient number of longitudinal reinforcing bar connections have been made to ensure that the pre-fabricated reinforcement cage is stable, the lifting bars are free to be extracted from the pre-fabricated reinforcement cage and reused for subsequent or future pre-fabricated reinforcement cages.

The internally threaded sleeves may be cylindrical or alternatively be of polygonal shape, such as hexagonal for example, and may be provided integral, or may be split sleeves. They can be welded directly to the cage frame plates or may be connected to the cage frame plates by first welding the internally threaded sleeves to steel flange plates and then bolting the thus prepared sleeve assembly to the cage frame plates with standard threaded fasteners. Optional flanged nuts prevent unintentional rotation of flanged nuts with respect to the lifting bar. It is also noted that the threaded sleeves may be placed over and rotated over the externally threaded reinforcing bars, or the threaded reinforcing bars may be rotated into the threaded sleeves, and then welded or otherwise fastened to the axially aligned cage frame plates.

In an alternative embodiment, smooth bore sleeves may be used in place of the internally threaded sleeves, and holding means such as locking nuts threaded onto the reinforcing bars are secured against the smooth bore sleeves thereby holding the cage frame in a fixed position along the length of the pre-fabricated reinforcement cage, while still allowing the longitudinal reinforcing bar to rotate within the smooth bore sleeve.

In another alternative embodiment, internally threaded sleeves and smooth bore sleeves with holding means such as locking nuts are used in combination.

BRIEF DESCRIPTION OF THE DRAWINGS

The present invention can best be understood in connection with the accompanying drawings. It is noted that the invention is not limited to the precise embodiments shown in drawings, in which:

FIGS. 6A and 6A1 are sectional views of alternate shapes of the internally threaded sleeves of the prefabricated reinforcement cage.

FIGS. 6B and 6B1 are sectional views of alternate embodiments for the attachment of the internally threaded sleeves of the prefabricated reinforcement cage to the cage frame.

FIGS. 6C and 6C1 are sectional views of alternate embodiments for split sleeve embodiments for the internally threaded sleeves.

DRAWINGS

Reference Numerals

Figure 1:
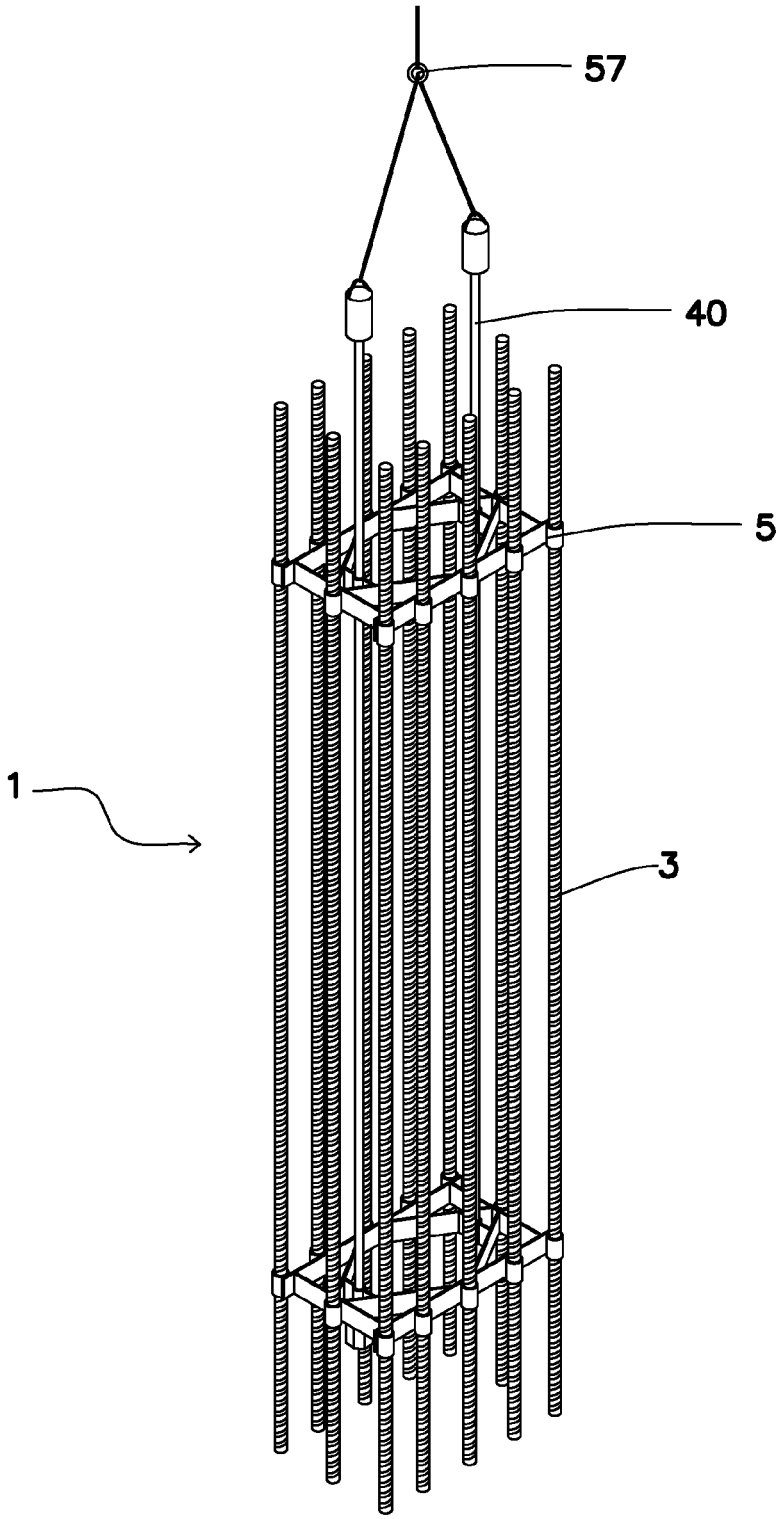
FIG. 1 is an isometric view of the prefabricated reinforcement cage of the preferred embodiment of the present invention.

For illustrative purposes only, a preferred mode for carrying out the invention is described herein, wherein the following reference numerals are non-limiting examples.

1. Pre-fabricated reinforcement cage
3. Longitudinal reinforcing bar
5. Cage frame
7. Cage frame plates
9. Internally threaded sleeve
10. Smooth bore sleeve
11. Transvers tie reinforcing
13. Transvers reinforcing erection wire
15. Lifting bar guide collar
20. Cylindrically shaped sleeve
21. Polygonal shaped sleeve
23. Welds
25. Flange plate
27. Fastener
29. Hinge
31. Split sleeve
40. Lifting bar
40A. Smooth lifting bar
40B. Continuously threaded lifting bar
41. Lifting collar
43. Internally threaded lifting collar
45. Lifting ring
47. Lifting bar bearing plate
49. Lifting bar flanged nut
51. Lifting bar bearing nut
52. Internal threading
53. External threading
55. Set screw
57. Rigging
59. Temporary holding means
61. Bar rotating tool
62. Internally threaded sleeve rotating tool
63. Fabrication aids
65. Reinforcement coupling
66. Locking nut
67. Brace
68. Thread Alignment Bar
69. Fixed Base for Thread Alignment Bar
70. Thread Alignment Marking on Fixed Base
71. Thread Alignment Marking on Internally Threaded Sleeve

DETAILED DESCRIPTION OF THE INVENTION

The subject of the present invention will now be described, with reference to the accompanying drawings shown in FIGS. 1-16. Where similar components are shown in multiple figures, the respective description of the parts may not be repeated.

Referring to FIGS. 1-5, the pre-fabricated reinforcement cage (1) of the present invention is comprised of at least two three dimensional cage frames (5) having plates extending axially with respect to the longitudinal axis of the longitudinally extending reinforcing bars (3). The cage frames (5) are comprised preferably of axially extending steel plates (7) and axially extending internally threaded sleeves (9), having an internal threading pattern that is complimentary to the external threading pattern of the longitudinal reinforcing bars (3) to be described shortly. The internally threaded sleeves (9) are preferably comprised of steel and of cylindrical shape. The three dimensional cage frames (5) can be lifted up by one or more connectors, which are removably connected to a lifting apparatus, with cables and rigging. For example, preferably the three dimensional cage frames (5) are also optionally provided with lifting bar guide collars (15), to be described shortly.

Figure 1A:
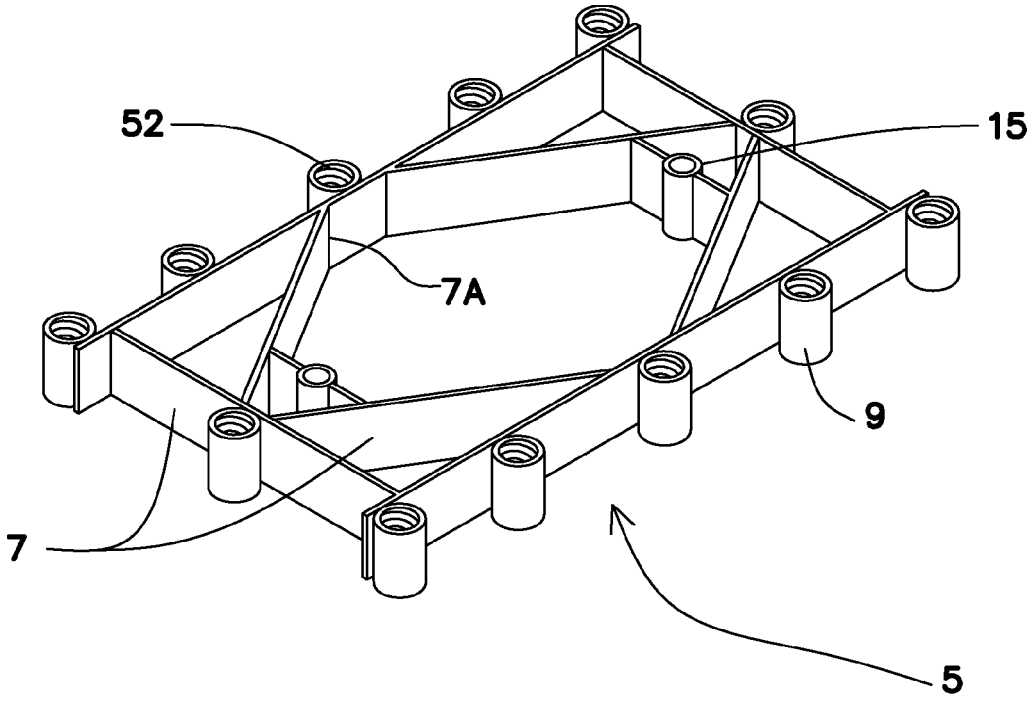
FIG. 1A is an isometric view of the three dimensional cage frame of the prefabricated reinforcement cage of the preferred embodiment of the present invention.

The cage frame plates (7), internally threaded sleeves (9) and lifting bar guide collars (15) are fastened together, preferably by welding as shown by weld (7*a*) in FIG. 1A, with or without brackets connecting guide collars (15) to frame plates (7). Longitudinal reinforcing bars (3), having continuous external thread-like deformations along their length, are installed into the internally threaded sleeves (9) during the fabrication to be described later. Such so-called threadbar reinforcement is available from domestic and international suppliers, such as Dywidag Systems International, Williams Form Engineering and SAS Stressteel, to name a few.

Each cage frame (5) functions as a rigid structural frame defining the dimensions of the pre-fabricated reinforcement cage (1) and the locations of the longitudinal reinforcing bars (3), while providing great strength and rigidity to the pre-fabricated reinforcement cage (1). The dimensions of the pre-fabricated reinforcement cage (1) and the quantity and locations and of the internally threaded, axially extending sleeves (9) and longitudinal reinforcing bars (3) is determined by design. The spatial geometry of the three dimensional cage frame (5), the thickness of the axially extending cage frame plates (7) and axially extending internally threaded sleeves (9), as well as the welds and fasteners, as the case may be, are also determined by design, based upon the weight of the pre-fabricated reinforcement cage and the transportation and erection forces, among other things.

Figure 1B:
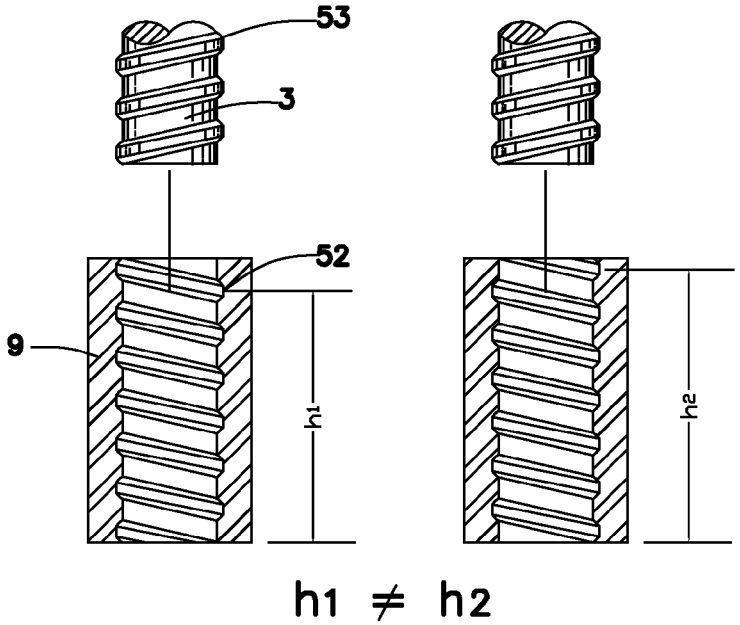
FIG. 1B is a sectional view of two adjacent internally threaded sleeves where the internal threading is not in alignment along the longitudinal axis.
Figure 1C:
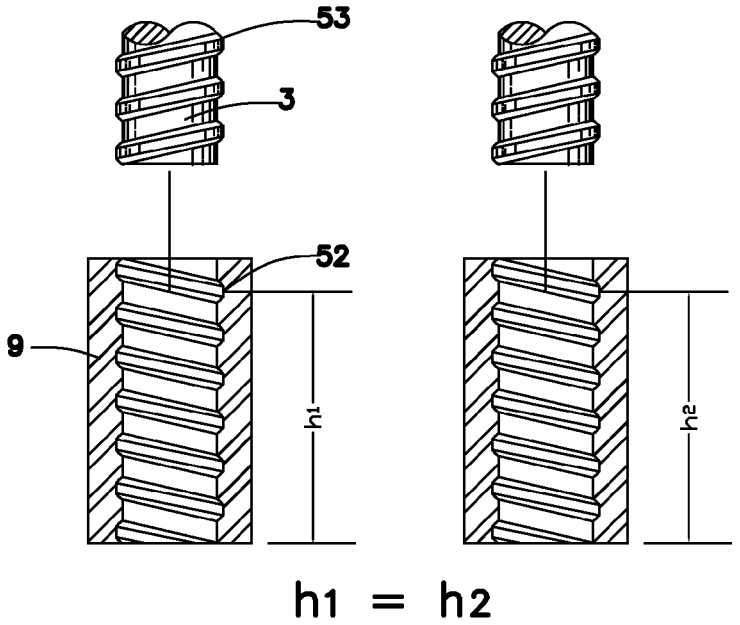
FIG. 1C is a sectional view of two adjacent internally threaded sleeves where the internal threading is in alignment along the longitudinal axis.
Figure 1D:
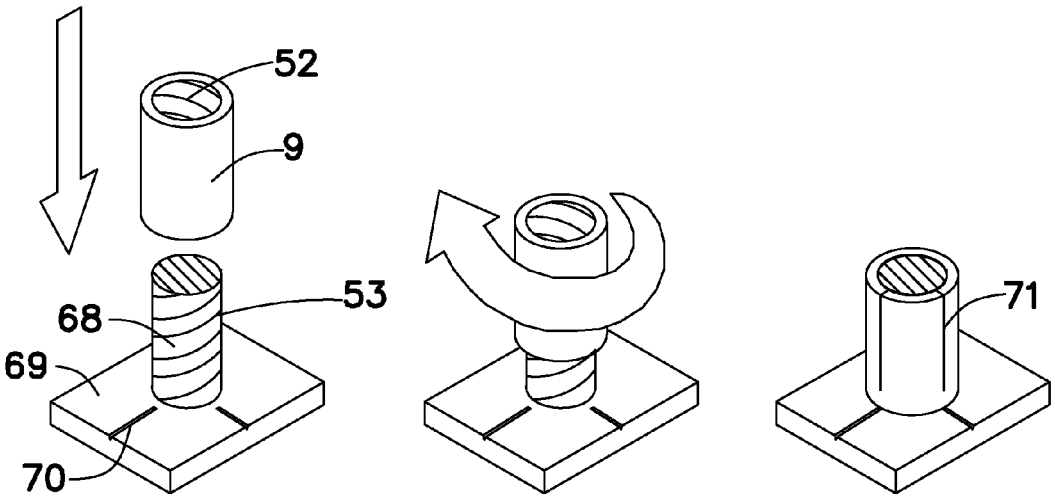
FIG. 1D is an isometric view of an alignment tool to ensure alignment of the internal threading along the longitudinal axis of the adjacent axially extending internally threaded sleeves FIG. 2 in an elevation view of the prefabricated reinforcement cage of the preferred embodiment of the present invention.
Figure 2:
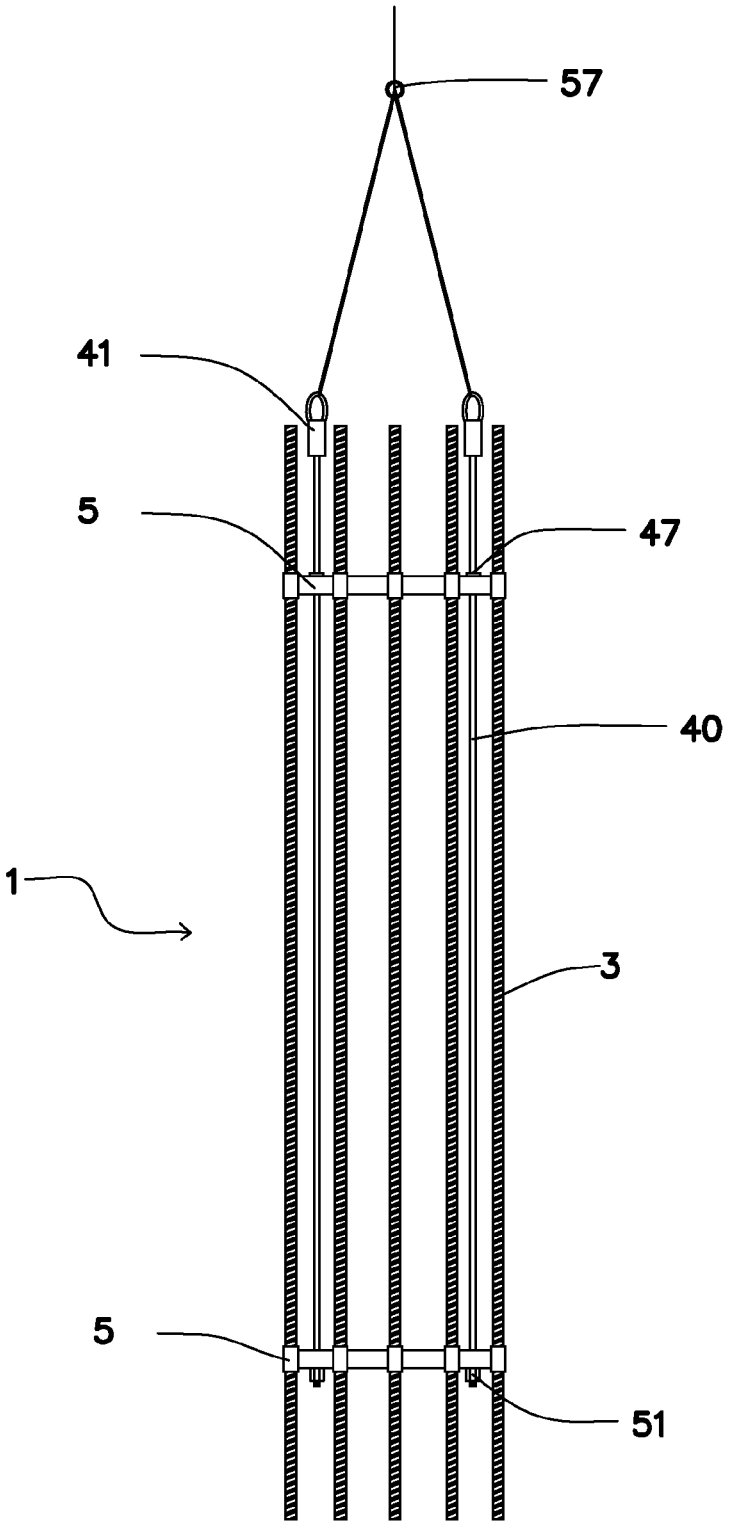
Figure 3:
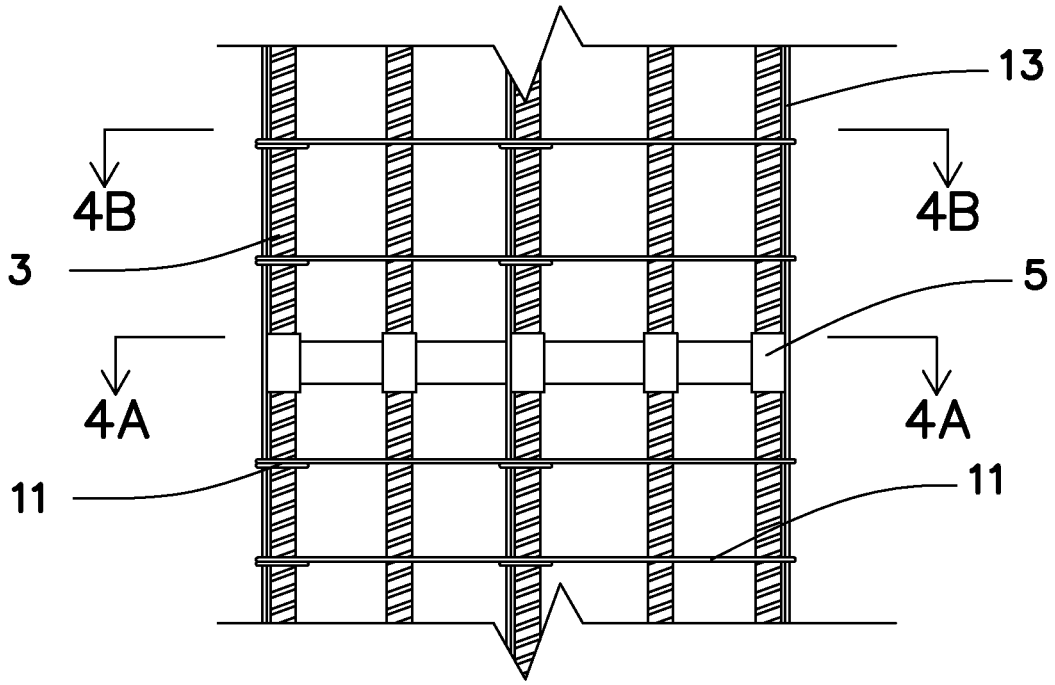
FIG. 3 in a close-up elevation view of the prefabricated reinforcement cage of the preferred embodiment of the present invention with the transverse tie reinforcement present.
Figure 4A:
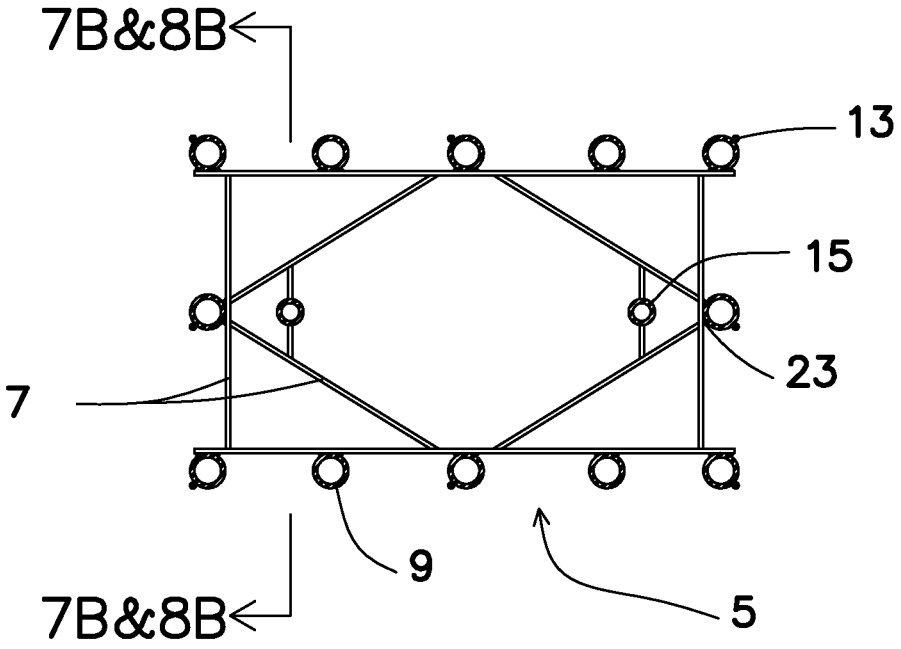
FIG. 4A is a plan view of the three dimensional cage frame of the prefabricated reinforcement cage of the preferred embodiment of the present invention.
Figure 4B:
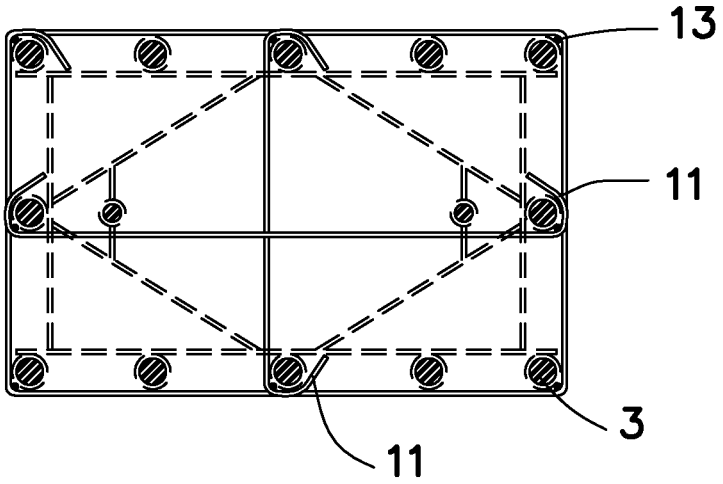
FIG. 4B is a plan view of the longitudinal and transverse reinforcing bars of the prefabricated reinforcement cage of the preferred embodiment of the present invention away from the cage frame, which is shown beyond.
Figure 5A:
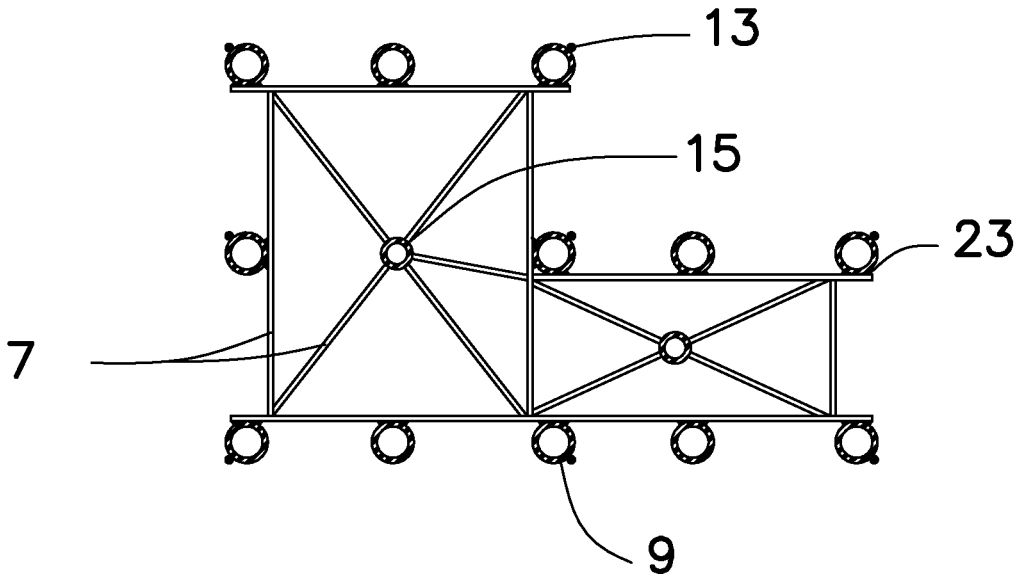
FIG. 5A is a plan view of an alternate embodiment for a multiple rectangle configuration of a cage frame, of the many possible cage frame configurations.
Figure 5B:
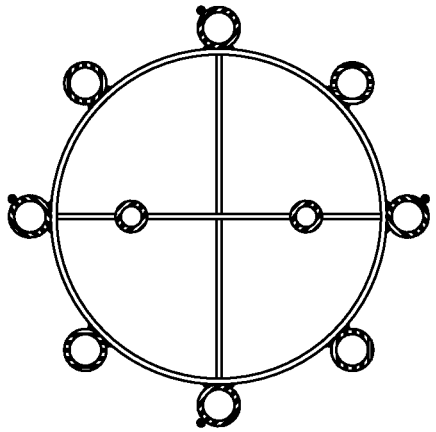
FIG. 5B is a plan view of an alternate embodiment of a circular cage frame.
Figure 7A:
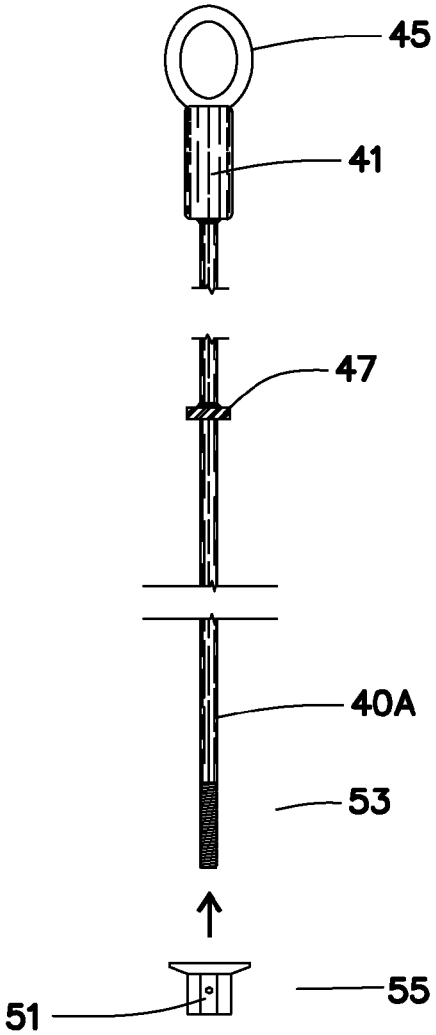
FIG. 7A is an elevation view of a preferred embodiment of a lifting apparatus, such as a lifting bar, of the present invention.
Figure 7B:
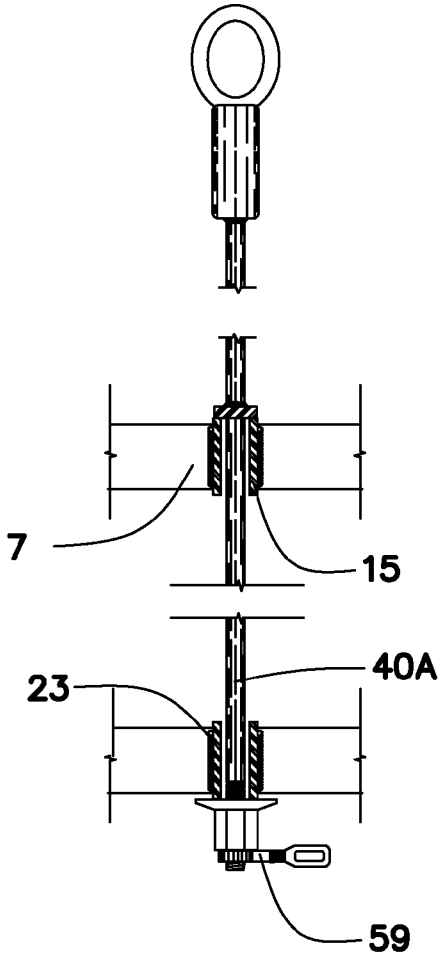
FIG. 7B is a sectional view through the cage frame of the preferred embodiment of a lifting apparatus of the prefabricated reinforcement cage of the present invention, shown at the location of the lifting bar in FIG. 7A.

Referring to FIGS. 1B-1D, alignment of the internal threading (52) of the internally threaded sleeves (9), such that the locations h1 and h2 of the internal threading along the longitudinal axis is consistent between adjacent internally threaded sleeves (9), is provided use of an alignment tool, which is formed by attaching a thread alignment bar (68) that is complimentary to the internally threaded sleeves (9) to a base, having a planar surface that is substantially perpendicular to the longitudinal axis of the thread alignment bar (68). The fixed base (69) is preferably made of steel and the thread alignment bar (68) is attached to the steel plate, preferably by welding. Markings (70) are preferably made on the fixed base. Internally threaded sleeves (9) are rotated onto the complimentary thread alignment bar (68) until the base of the internally threaded sleeves (9) comes into intimate contact with the surface of the fixed base (69). With the base of the internally threaded sleeves (9) in intimate contact with the surface of the fixed base (69), markings (71) are preferably made on the internally threaded sleeves (9) that are in alignment with the markings (70) made on the fixed base (69). Aligning the marks (71) thus made on the internally threaded sleeves (9) ensures substantial alignment of the internal threading (52) of internally threaded sleeves (9) along the longitudinal axis.

Referring again to FIGS. 1-2 and FIGS. 7A and 7B, where the pre-fabricated reinforcement cage (1) is preferably installed in a vertical or substantially vertical orientation, the pre-fabricated reinforcement cage (1) is provided with at least one, and preferably two, lifting bars (40) inserted through the lifting bar guide collars (15) on the three dimensional cage frame (5). Those skilled in the art will recognize that current construction safety regulation will generally require at least two such lifting bars for erection. The lifting bars (40) are comprised preferably of steel bars with external threading (53) at one end to accept a fastener, such as nut (51), having complimentary internal threading. The nut (51) is preferably provided with a temporary holding means (59) comprised preferably of a spring clamp, but alternatively may be provided with another fastener, such as a standard set screw (55). The opposite end of the lifting bar (40) is provided with a lifting collar (41) onto which a preferably steel lifting ring (45), or hook eye, is attached. The lifting collar (15) is preferably comprised of steel cylinder that is preferably welded to the lifting bar. Alternatively, the lifting collar may be provided with an internally threaded annulus, and threaded onto a complimentary externally threaded end of the lifting bar (40). The lifting bar guide collars (15) are comprised preferably of steel sleeves fastened to the three dimensional cage frame (5) made of axially extending cage frame plates (7). The annular space of the lifting bar guide collar (15) is preferably of sufficient dimension to permit free movement of the lifting bars (40) through it. The lifting bars (40) are also provided with a bearing plate (47) to prevent movement of the lifting bar (40) through the lifting bar guide collars (15) after the bearing nut (51) has been installed.

The aforementioned lifting apparatus may be adapted for use with other prefabricated bar assemblies, such as conventionally used bar cages and that of Ferrer '678 and Ferrer '479.

Referring again to FIGS. 3-4B, any required transvers tie reinforcement (11), such as beam stirrups or column and wall ties and confinement, is preferably installed onto the pre-fabricated reinforcement cage (1) during the fabrication process. The ties are preferably installed around erection wires (13). The erection wires (13) are preferably comprised of steel rods that are welded to the internally threaded, axially extending sleeves (9) of the axially extending cage frames (5). The use of such erection wires is common practice in the pre-fabrication of reinforcement cages.

Figure 9A:
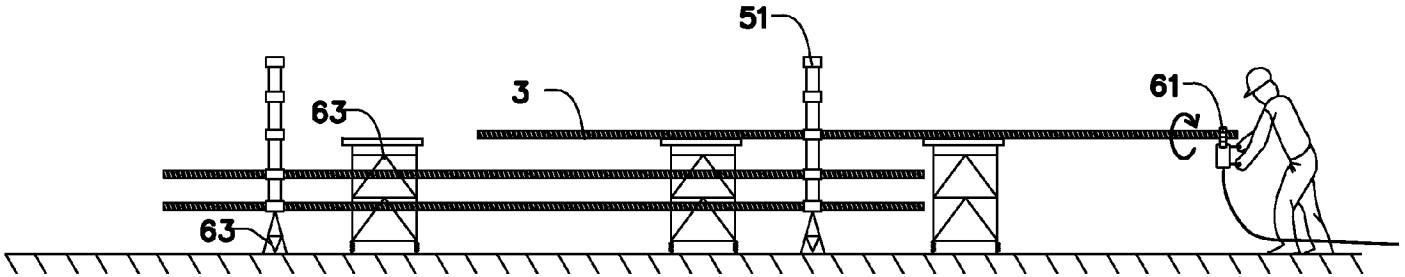
FIG. 9A is an elevation view of the fabrication procedure of the prefabricated reinforcement cage of the preferred embodiment of the present invention.
Figure 9B:
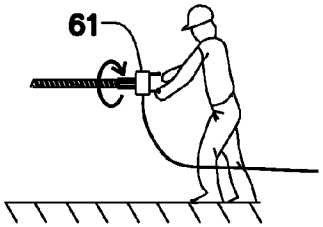
FIG. 9B is an elevation view of an alternative location for applying a rotating tool to the reinforcing bars of the prefabricated reinforcement cage of the preferred embodiment of the present invention.
Figure 9C:
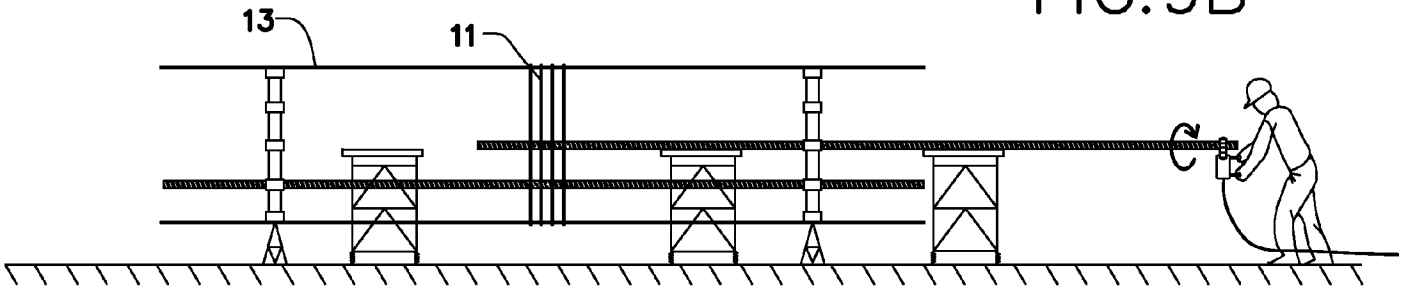
FIG. 9C is an elevation view of the fabrication procedure of the prefabricated reinforcement cage of the preferred embodiment of the present invention with the transverse tie reinforcement present, wherein the arrow indicates a preferred direction of rotational movement.

Referring to FIGS. 9-10, the pre-fabricated reinforcement cage (1) may be constructed in a shop or at the site by first assembling the three dimensional cage frames (5) and setting them into position with the use of gigs, bracing and other fabrication aids utilized in common practice. As shown in FIG. 9C, If it is desired to install the transverse tie reinforcement (11) with the pre-fabricated reinforcement cage (1), the transverse reinforcing erection wires (13) are then welded to the internally threaded sleeves (9) as necessary and the transverse tie reinforcement (11) is then installed onto the transverse reinforcing erection wires (13) and preferably grouped at a convenient location for later dissemination along the length of the pre-fabricated reinforcement cage (1).

The longitudinal reinforcing bars (3) are installed into the thus assembled cage frames preferably by rotating the bars through the respective axially aligned, internally threaded, axially extending sleeves (9) of the cage frames (5) to the desired position along the length of the pre-fabricated reinforcement cage (1). Mechanical rotating tools are preferably used to facilitate the installation. Such rotating tools are commonly used in the construction industry, for example to spin or rotate pipes. The rotating tools can be applied along the side of the bars as shown in FIG. 9A, or at least one end of the bar as shown in FIG. 9B.

Figure 10A:
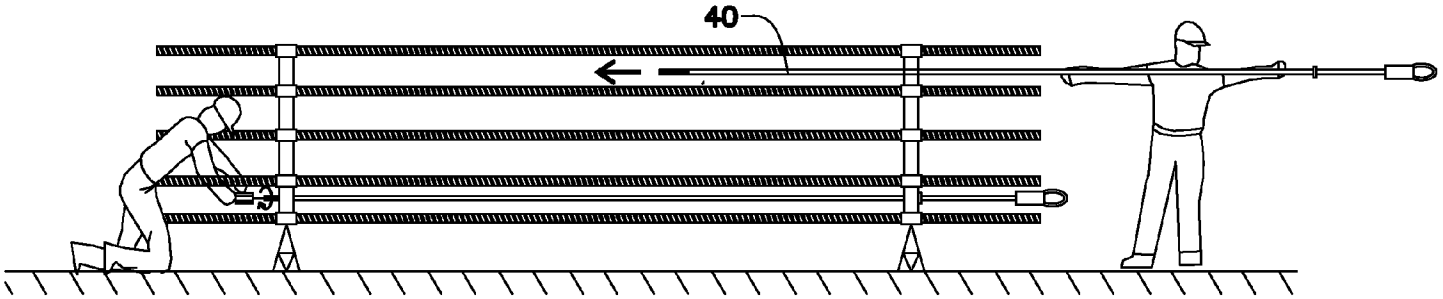
FIG. 10A is an elevation view of the installation of the lifting bar into the prefabricated reinforcement cage of the preferred embodiment of the present invention.

As shown in FIG. 10A, at any time before, during or after the longitudinal reinforcing bars (3) are installed to their intended position in the pre-fabricated reinforcement cage (1), the lifting bars (40) are installed through the lifting bar guide collars (15) to their intended position in the pre-fabricated reinforcement cage (1), and the bearing nut (51) is installed. The location of the bearing plate (47) will correspond to the desired length of embedment of the lifting bars (40) into the pre-fabricated reinforcement cage (1) and prevent subsequent movement of the lifting bar (40) through the lifting bar guide collar (15). A temporary holding means (59), preferably a spring clamp, may then be installed to prevent unintended rotation of the bearing nut (51) relative to the lifting bar (40)

Figure 10B:
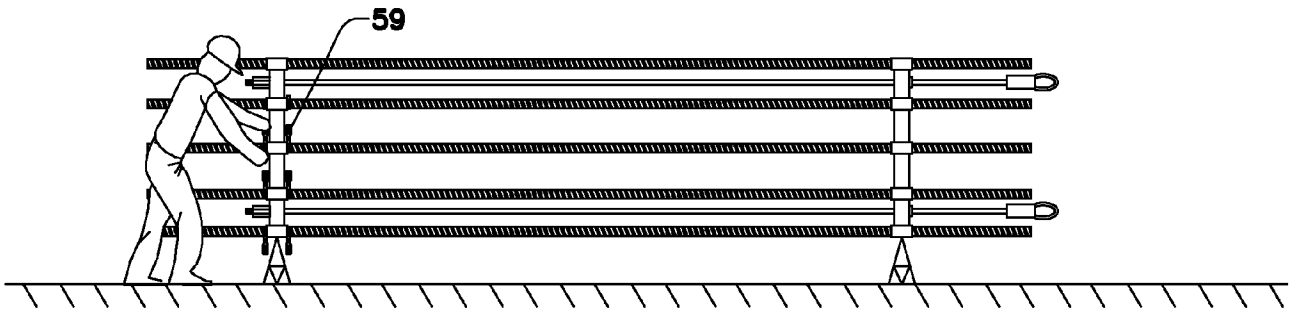
FIG. 10B is an elevation view of the installation of the temporary holding means onto the longitudinal reinforcing bars of the prefabricated reinforcement cage of the preferred embodiment of the present invention.

As shown in FIG. 10B, after the longitudinal reinforcing bars (3) are installed to their intended position in the pre-fabricated reinforcement cage (1), temporary holding means (59), preferably a spring clamp, may be installed on opposite sides of the internally threaded sleeves (9) to prevent unintended rotation of the longitudinal reinforcing bars (3) relative to the threaded sleeves (9).

Referring to FIGS. 12-16, the pre-fabricated cage (1) including the reinforced bars (3) and the three dimensional reinforcement cage(s) frame(s) (5), thus constructed, can be transported to the construction site. Where the pre-fabricated reinforcement cage (1) will be installed in a vertical or substantially vertical orientation, the hoisting rigging (57) is attached to the lifting collars (41) of the lifting bars (40). For horizontal, or substantially horizontal applications, the pre-fabricated reinforcement cage(s) (1) can be rigged in a typical manner. The pre-fabricated reinforcement cage(s) (1) are then lifted to their intended locations and in alignment with any adjacent reinforcement to which it is intended to be connected. Prior to making such connection, any temporary holding means (59) installed during the fabrication are to be removed, thus allowing the longitudinal reinforcing bars (3) to rotate freely within the internally threaded sleeves (9), which are attached to the cage frame plates (5) of the reinforcing cage (1). The longitudinal reinforcing bars may then be connected, or coupled, together my typical methods. Once a sufficient number of longitudinal reinforcing bar connections have been made to ensure that the pre-fabricated reinforcement cage (1) is stable, the bearing nuts (51) of the lifting bars (40) may be removed, leaving the lifting bars (40) free to be extracted from the pre-fabricated reinforcement cage (1) and reused for subsequent or future pre-fabricated reinforcement cages.

Referring to FIG. 6A, the internally threaded sleeves (9) may alternatively be of polygonal shape, such as hexagonal for example.

Referring to FIG. 6B, in an alternate embodiment, the axially extending, internally threaded sleeves (9) may be connected to the axially extending cage frame plates (7) of cage frame (5) of the cage (1), by first welding the internally threaded sleeves (9) to steel flange plates (25) and then bolting the thus prepared sleeve assembly to the cage frame plates (7) with standard threaded fasteners (27).

Referring to FIG. 6C, in yet another alternate embodiment, the internally threaded sleeves (9) may be provided as a hinged split sleeve (31) that can be closed after installation of the longitudinal reinforcing bars (3) and secured with standard threaded fasteners (27).

Figure 8A:
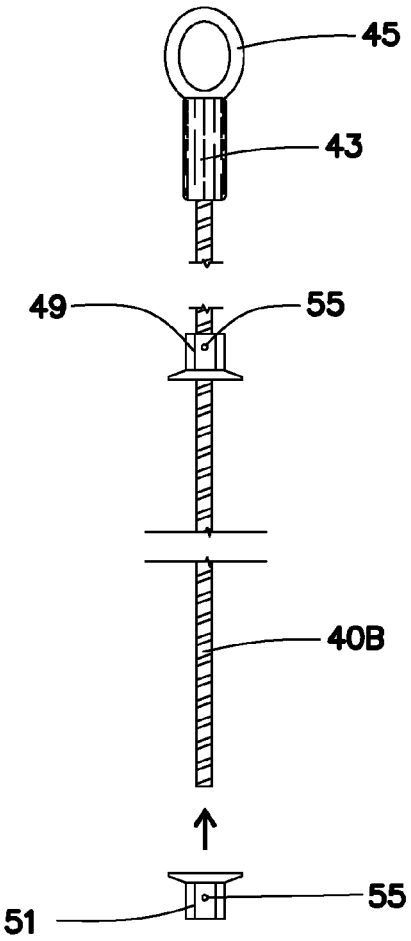
FIG. 8A is an elevation view of an alternative embodiment of a lifting apparatus, such as a lifting bar of the present invention.
Figure 8B:
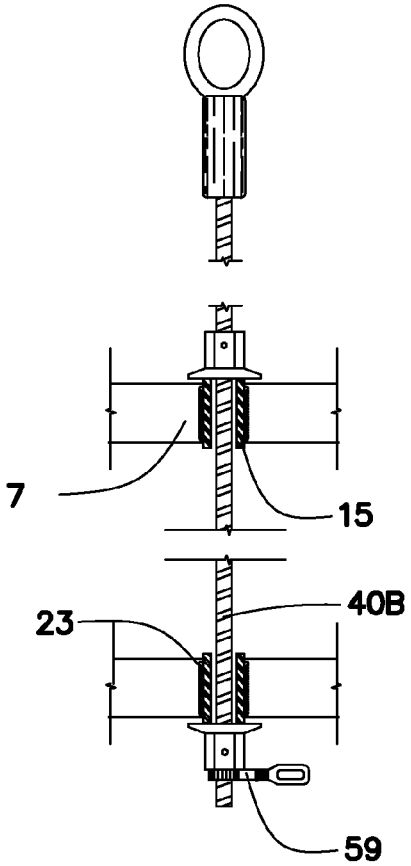
FIG. 8B is a sectional view through the cage frame at the location of the alternative embodiment of the lifting apparatus of the lifting bar of FIG. 8A.

Referring to FIGS. 8A and 8B, in an alternate embodiment, the lifting bars (40) may be comprised of continuously threaded bars. In this case, the bearing plate (47) may be replaced with a fastener, such as a flanged nut (49). The flanged nut (49) is provided preferably with a fastener, such as a standard set screw (55), to prevent unintended rotation of the flanged nut (49) relative to the lifting bar (40B).

Figure 11A:
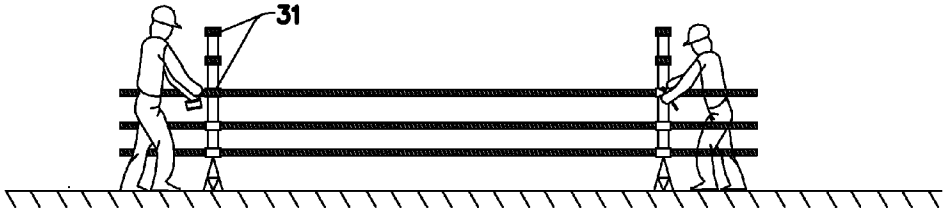
FIG. 11A is an elevation view of an alternative embodiment of the fabrication procedure of the prefabricated reinforcement cage.

Referring to FIG. 11A, in an alternate embodiment of the fabrication of the pre-fabricated reinforcement cage (1), where the internally threaded sleeves are provided as a hinged split sleeve (31), or two separate half pieces, the longitudinal reinforcing bars (3) are installed into position on the hinged split sleeve (31)), or two separate half pieces, and then secured with standard threaded fasteners (27).

Figure 11B:
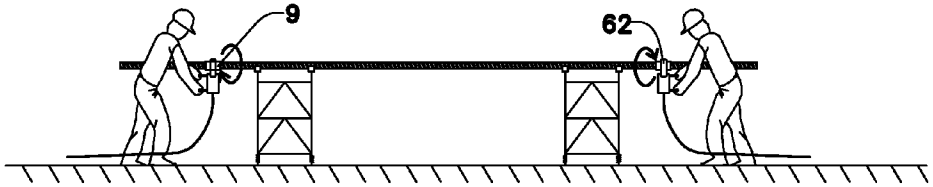
FIG. 11B is an elevation view of another alternative embodiment of the fabrication procedure of the prefabricated reinforcement cage.
Figure 11C:
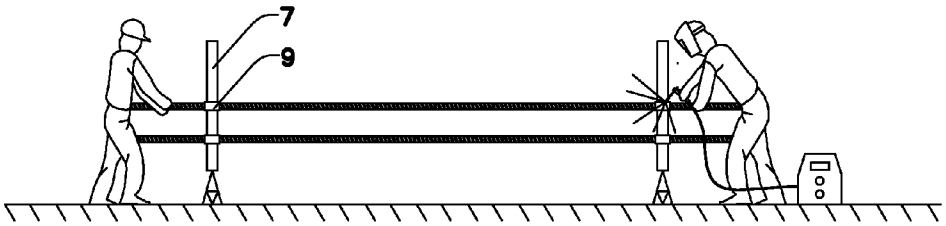
FIG. 11C is an elevation view of another alternative embodiment of the fabrication procedure of the prefabricated reinforcement cage of the present invention.

Referring to FIGS. 11B and 11C, in yet another alternate embodiment of the fabrication of the pre-fabricated reinforcement cage (1), the internally threaded sleeves (9) may be first placed onto the longitudinal reinforcing bars (3) to their intended position with the aid of mechanical rotating tools. The internally threaded sleeves (9) and longitudinal reinforcing bars (3) so assembled are then attached to the cage frame plates (7) at their intended locations, preferably by welding.

Referring to FIGS. 17, 17A, 18 and 19, in an alternate embodiment, smooth bore sleeves (10) are used in place of the internally threaded sleeves, and holding means such as locking nuts (66) preferably having internal threading are installed onto the longitudinal reinforcing bars (3) and secured against at least one side of the smooth bore sleeves (10), thereby holding the cage frame (5) in a fixed position along the length of the pre-fabricated reinforcement cage (1), while still allowing the longitudinal reinforcing bars (3) to rotate within the smooth bore sleeve (10). In the fabrication process using smooth bore sleeves (10) the longitudinal reinforcing bars (3) are charged through the axially aligned smooth bore sleeves (10) and secured against the smooth bore sleeves (10), with holding means such as locking nuts (66) on at least one side, thereby holding the cage frame (5) in a fixed position along the length of the pre-fabricated reinforcement cage (1).

Figure 20:
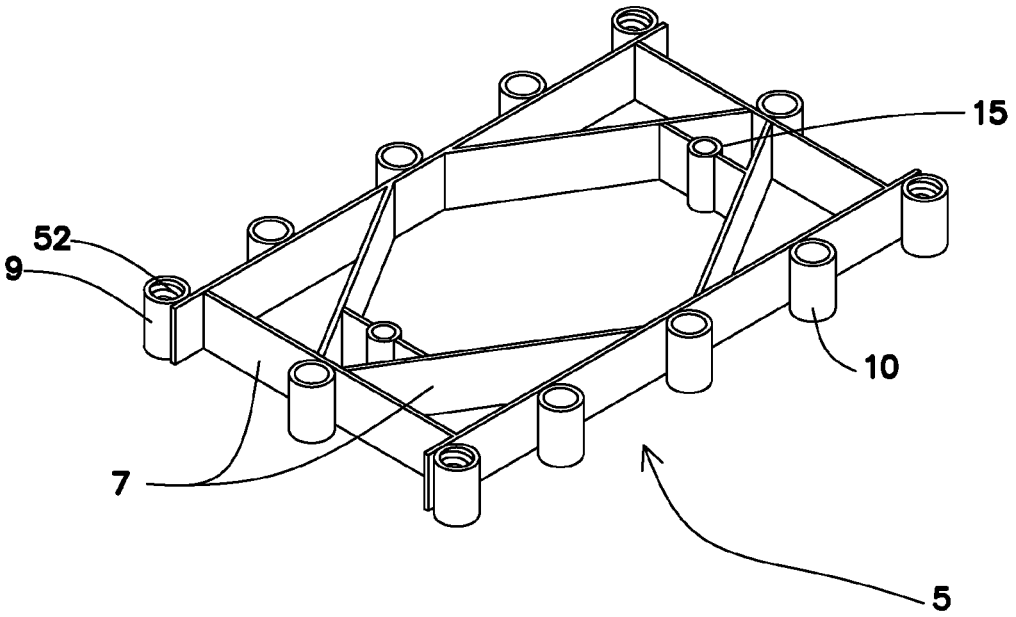
FIG. 20 is an isometric view of the three dimensional cage frame of another alternative embodiment of the present invention.
Figure 21:
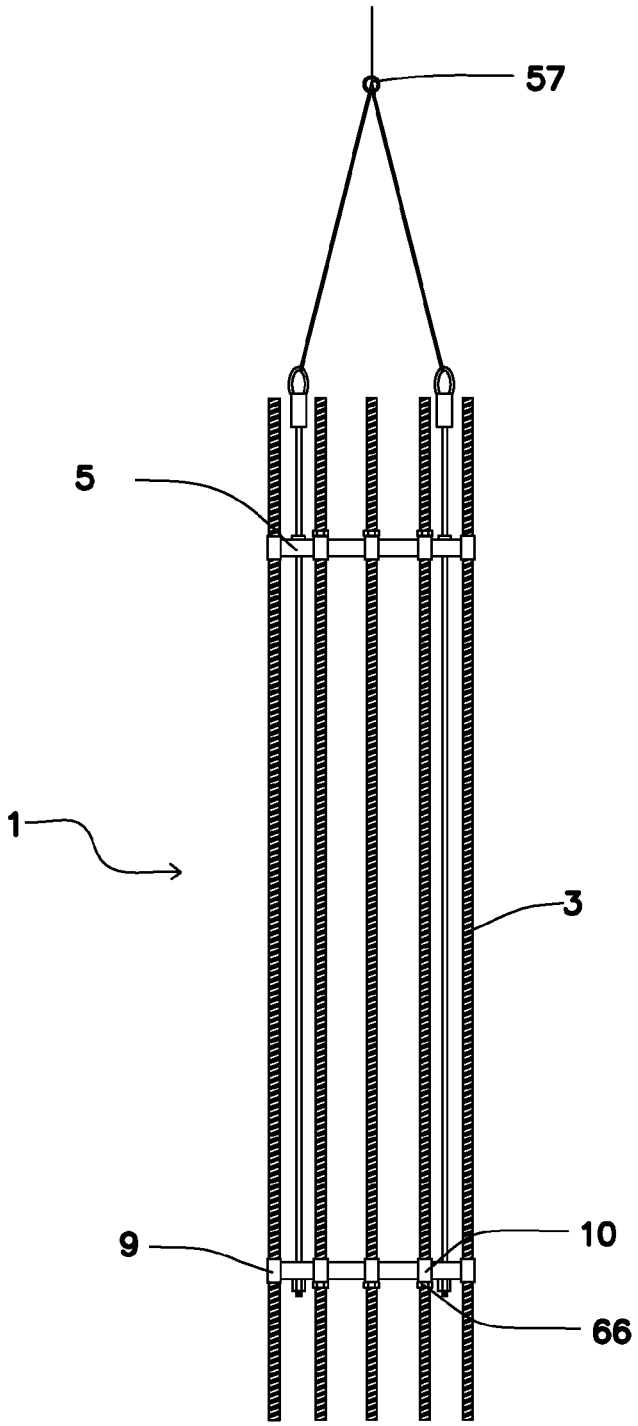
FIG. 21 in an elevation view of the prefabricated reinforcement cage of another alternative embodiment of the present invention

Referring to FIGS. 20 and 21, in another alternate embodiment, the above described smooth bore sleeves (10) and holding means such as locking nuts (66) and above described internally threaded sleeves (9) are used in combination. The smooth bore sleeves (10) and holding means such as locking nuts (66) and internally threaded sleeves (9) are fabricated respectively as previously described.

Figure 12A:
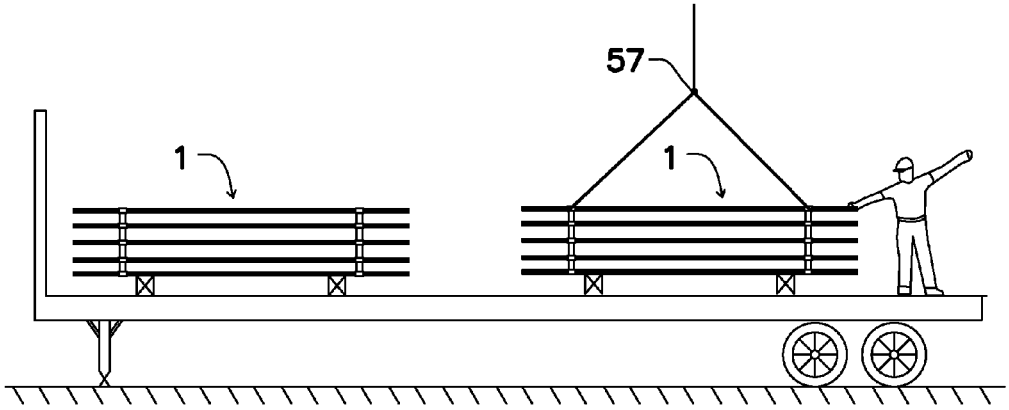
FIG. 12A is an elevation view of the on-site erection sequence of the prefabricated reinforcement cage of the present invention used in a horizontal application.
Figure 13:
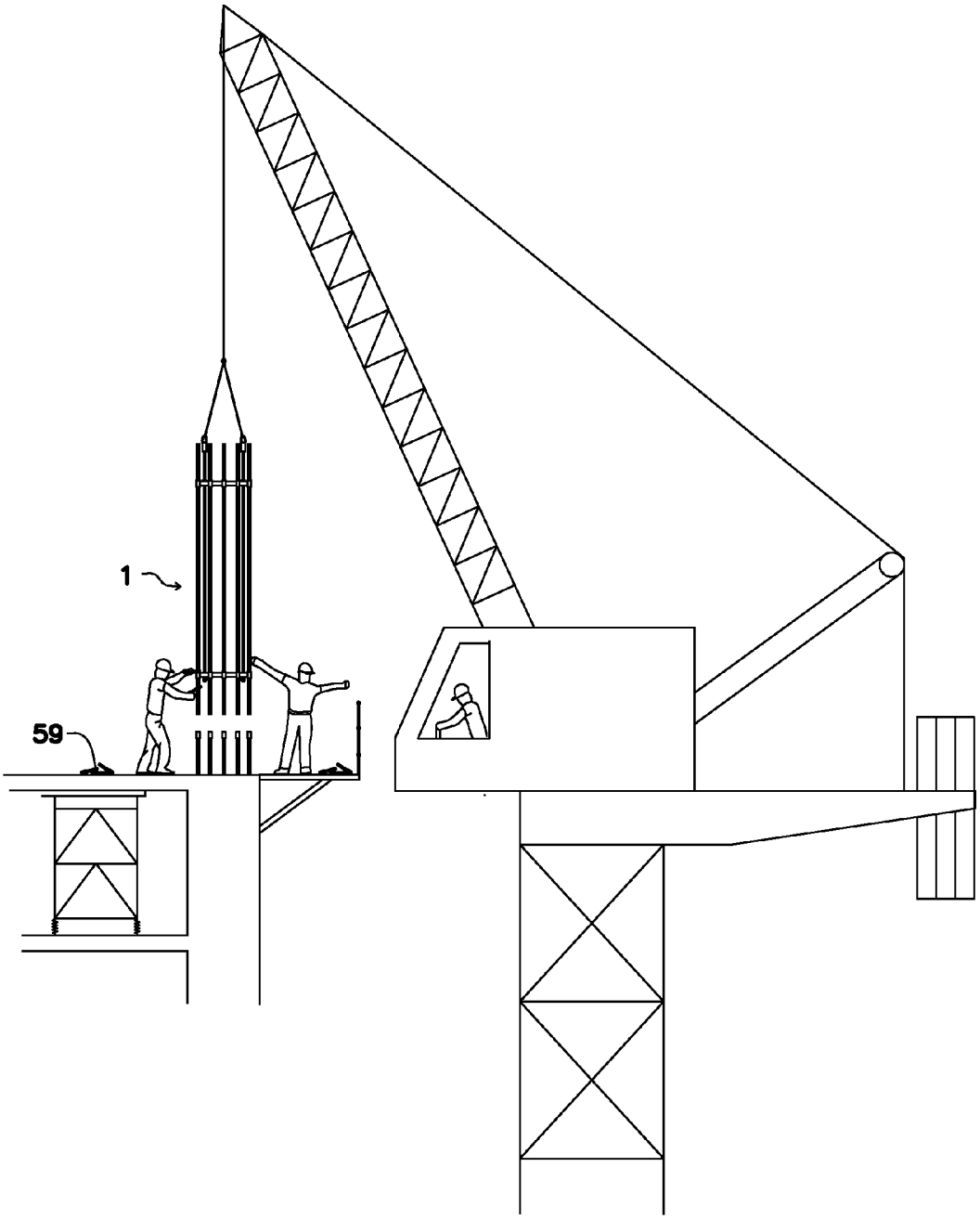
FIG. 13 is an elevation view of the continuation of the on-site erection sequence of the prefabricated reinforcement cage used in a vertical application.
Figure 14:
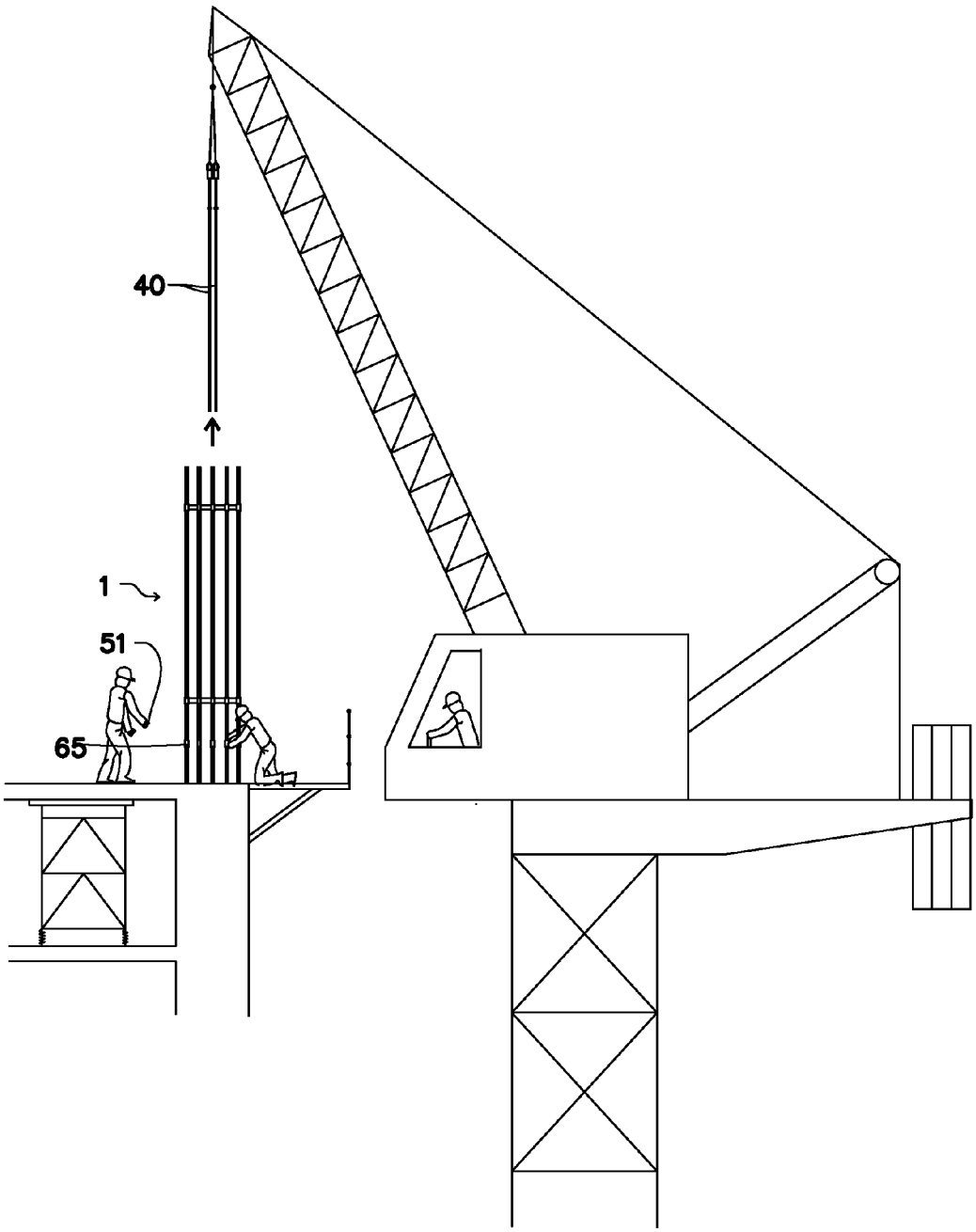
FIG. 14 is an elevation view of the continuation of the on-site erection sequence of the prefabricated reinforcement cage used in a vertical application.
Figure 15:
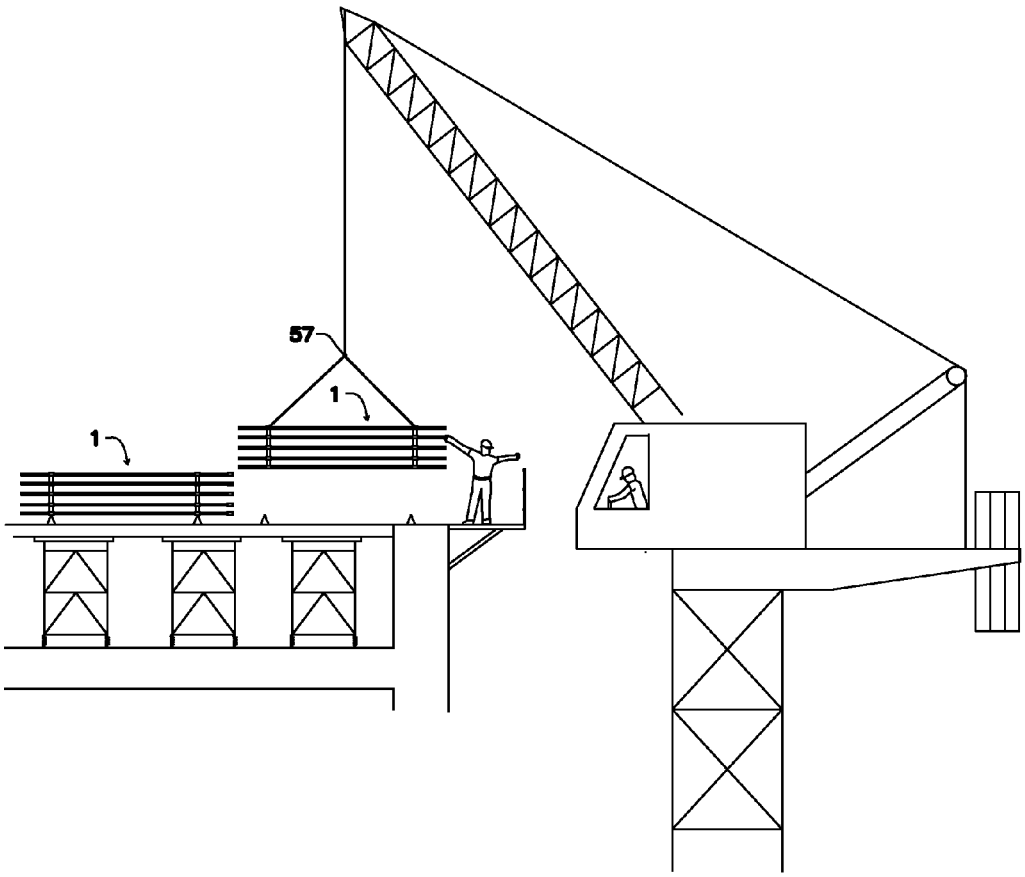
FIG. 15 is an elevation view of the continuation of the on-site erection sequence of the prefabricated reinforcement cage used in a horizontal application.
Figure 16:
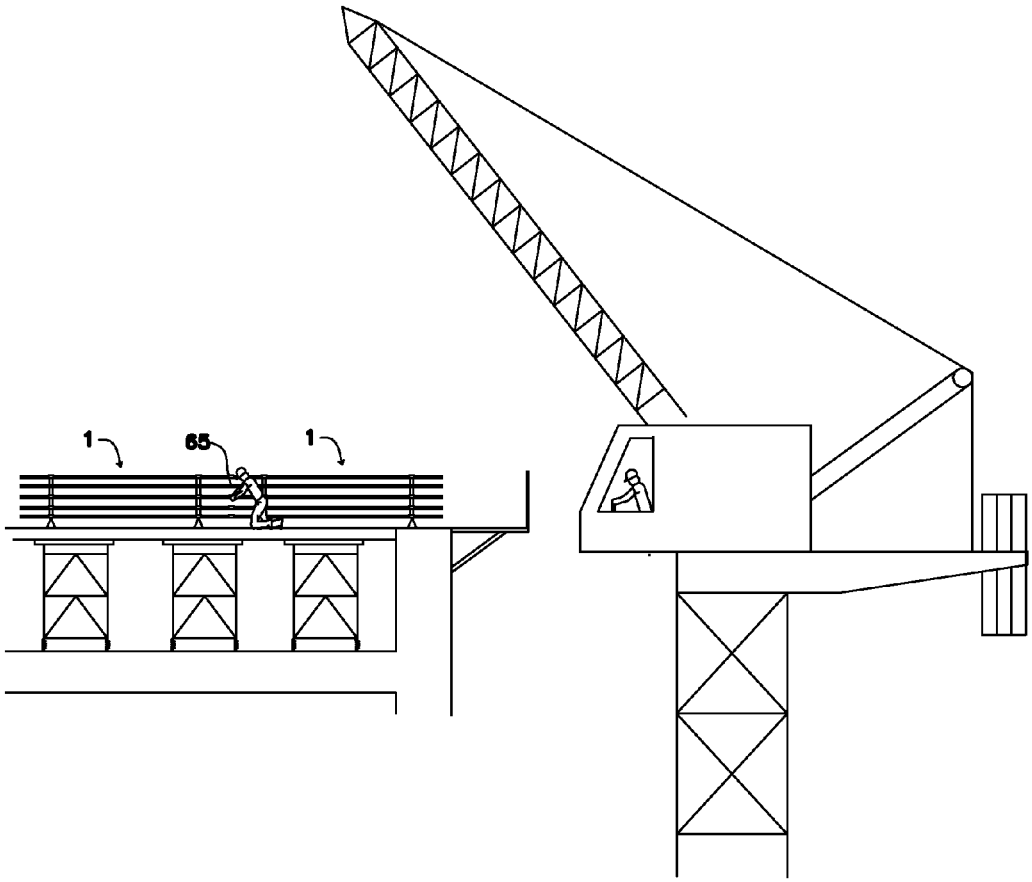
FIG. 16 is an elevation view of the continuation of the on-site erection sequence of the prefabricated reinforcement cage used in a horizontal application.
Figure 17:
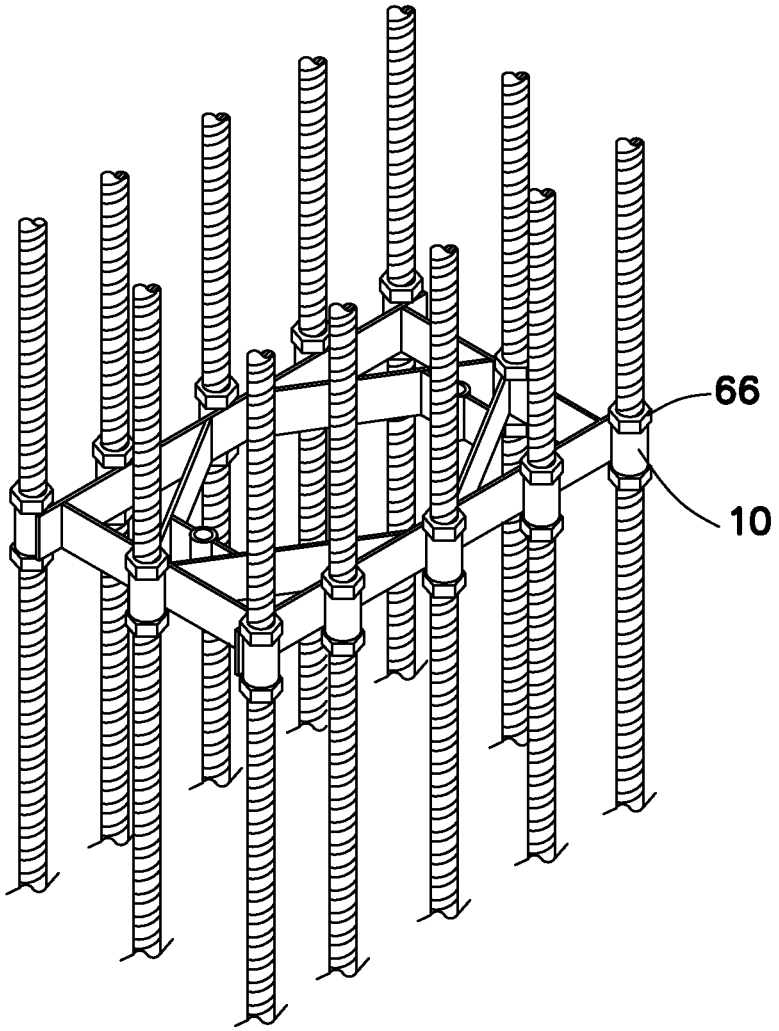
FIG. 17 is a partial isometric view of the prefabricated reinforcement cage of an alternative embodiment of the present invention
Figure 17A:
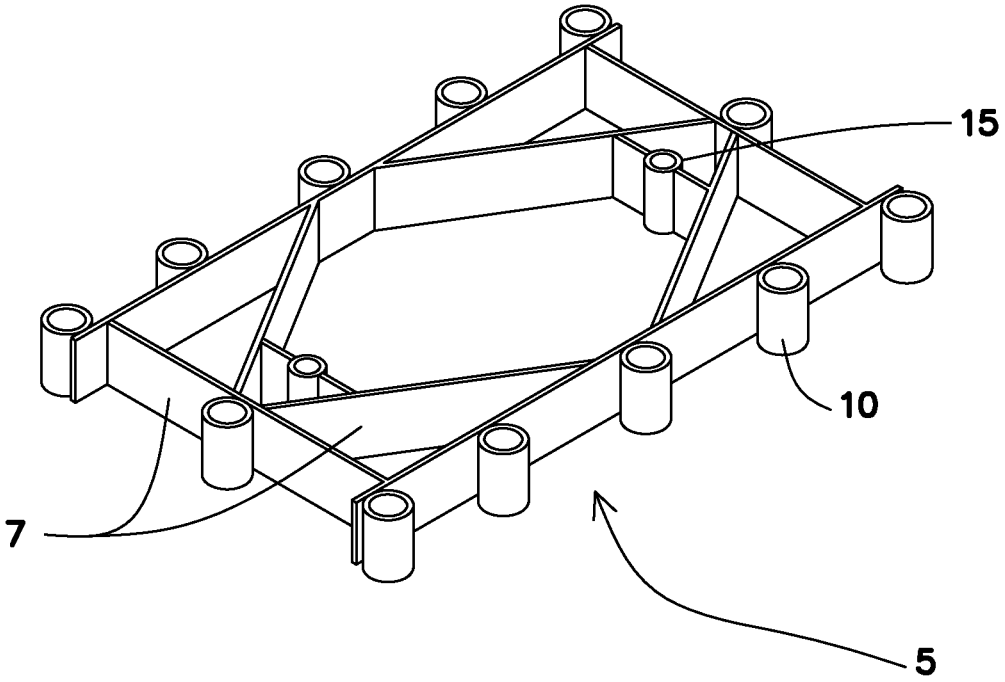
FIG. 17A is an isometric view of the three dimensional cage frame of an alternative embodiment of the present invention.
Figure 18:
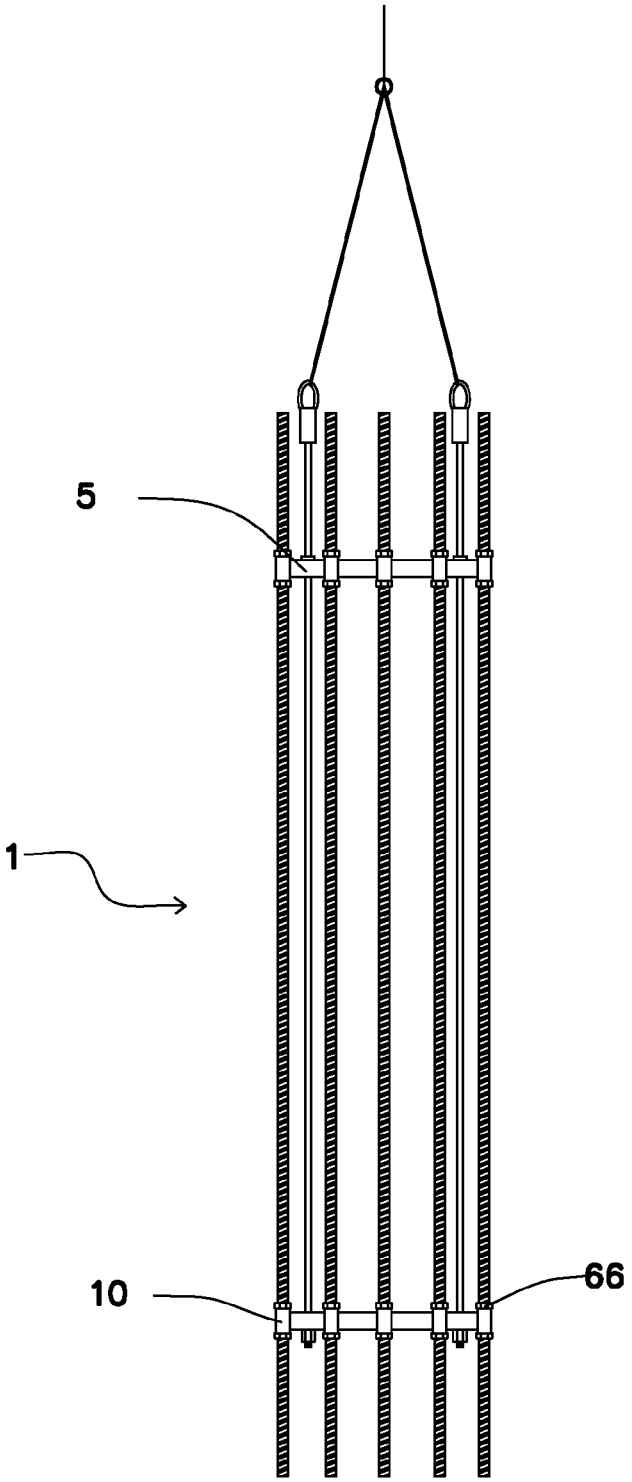
FIG. 18 in an elevation view of the prefabricated reinforcement cage of an alternative embodiment of the present invention.
Figure 19:
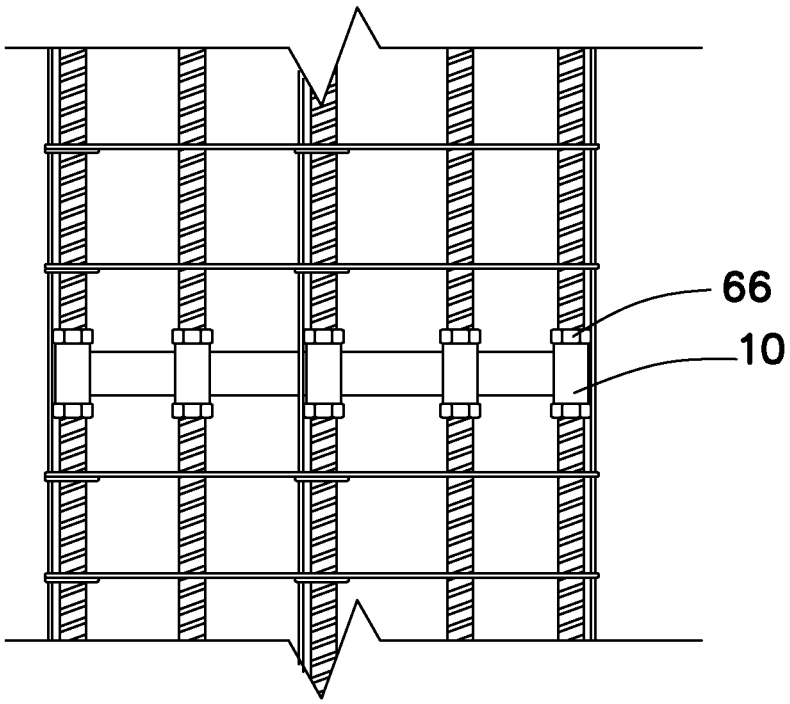
FIG. 19 in a close-up elevation view of the prefabricated reinforcement cage of an alternative embodiment of the present invention.

Referring to FIGS. 12A, 12B, 13, 14, 15 and 16, various modes are presented for on-site erection sequences. For example, FIGS. 12A, 15 and 16 depict an on-site erection sequence of the prefabricated reinforcement cage (1) of the present invention, where lifting with rigging (57) is used to place the prefabricated reinforcement cage (1) on-site in a horizontal orientation application at an installation site. FIG. 16 shows the continuation of the on-site erection sequence of the prefabricated reinforcement cage (1) used in a horizontal application, where the reinforced cages (1) are set in place, through use of reinforcing couplings (65).

Figure 12B:
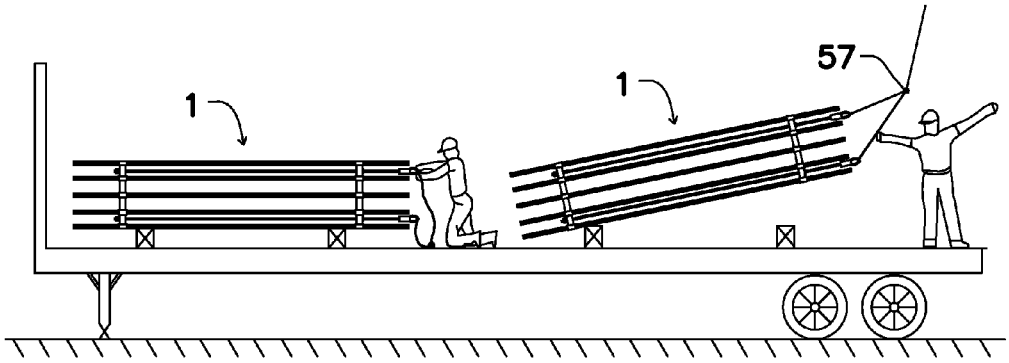
FIG. 12B is an elevation view of the on-site erection sequence of the prefabricated reinforcement cage of the present invention used in a vertical application.

In contrast, FIGS. 12B, 13 and 14 depict an on-site erection sequence of the prefabricated reinforcement cage (1) of the present invention, where, as shown in FIG. 12B, lifting with rigging (57) is used to place the prefabricated reinforcement cage (1) on-site in a vertical orientation application, such as further shown in FIG. 13 being lifted in place by heavy equipment, such as a derrick having a crane and lifting boom, at an installation site.

Possible Modifications and Variations

Figure 22:
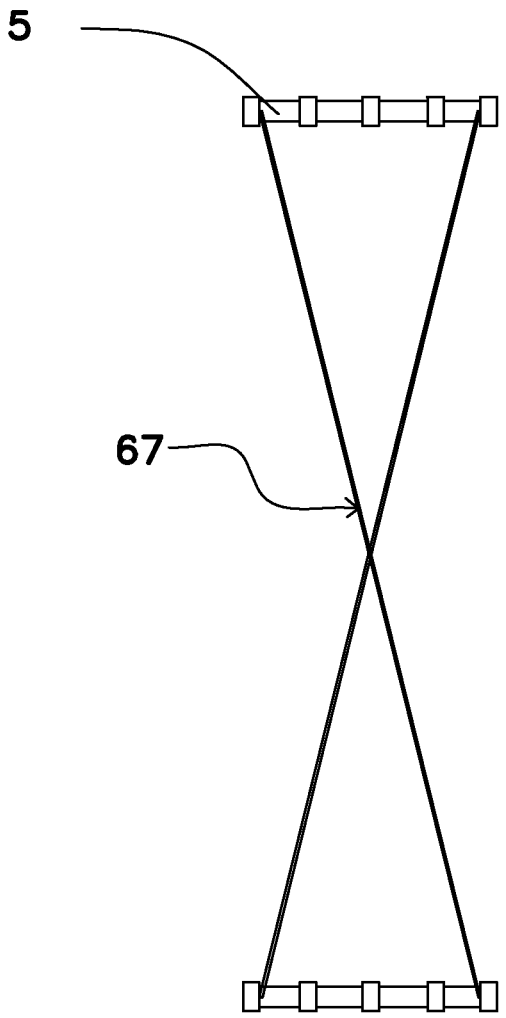
FIG. 22 is an elevation view of two three dimensional cage frames interconnected with bracing.

The foregoing description of one or more embodiments of the present invention has been presented for the purposes of illustration and description. While the foregoing detailed description of the invention enables one of ordinary skill to make and use the invention, those skilled in the art will understand and appreciate the existence of variations, modifications, combinations and equivalents of the specific embodiments and methods presented. It is understood that changes in the specific embodiments and methods shown and described may be made within the scope of the description without departing from the spirit of the invention. For example, the pre-fabricated reinforcement cage of the present may be used in any application utilizing threaded rod materials, and is not limited to concrete reinforcement applications. As another example, the cage frame plates of the present invention may be combined with an open lattice type framework, such as shown in FIG. 22.

I claim:

1. A pre-fabricated reinforcement cage for longitudinally extending concrete reinforcing bars supporting and extending intimately through concrete aggregate material, comprising:

a plurality of longitudinally extending concrete reinforcing bars, said plurality of longitudinally extending concrete reinforcing bars having an external threading pattern over at least a portion of their length, said plurality of longitudinally extending concrete reinforcing bars being held axially aligned in place in an axis by at least two three dimensional cage frames spaced apart from each other, said three dimensional cage frames fabricated by welding together plates of said cage frame, said plates aligned in the direction of said longitudinally extending concrete reinforcing bars occupying a minimal sectional area of concrete element being reinforced, to minimize any impediment to the flow of concrete, insuring a lack of stress transmission discontinuities, said fabrication of said three dimensional cage frames imparting strength and stiffness to the reinforcing cage, using minimal material while affording economical fabrication of a wide variety of said three dimensional cage frames, to accommodate design determined size and spatial geometries, as well as strength requirements, said three dimensional cage frames including at least one circumferentially extending plate, said at least one circumferentially extending plate extending axially parallel to said axis of said plurality of longitudinally extending reinforcing bars, said three dimensional cage frames each having a plurality of axially extending sleeves, each said sleeve having an internal threading pattern that is complimentary to an external threading pattern of each of said plurality of longitudinally extending concrete reinforcing bars, each said sleeve being rigidly fastened to said three dimensional cage frames, whereby said cage frame plates and axially aligned sleeves hold said plurality of longitudinally extending concrete reinforcing bars in an axially aligned parallel orientation while allowing said longitudinally extending concrete reinforcing bars to be rotated freely within said axially aligned sleeves.

2. The pre-fabricated reinforcement cage as in claim 1 wherein said at least one circumferentially extending plate of said cage frame is cylindrical.

3. The pre-fabricated reinforcement cage as in claim 1 wherein said at least one circumferentially extending plate of said cage frame is a plurality of plates forming at least one rectangle.

4. The pre-fabricated reinforcement cage as in claim 1 wherein said at least one circumferentially extending plate is a plurality of plates forming at least one polygon.

5. The pre-fabricated reinforcement cage as in claim 1 wherein said at least one circumferentially extending plate is a plurality of plates forming at least one square.

6. The pre-fabricated reinforcement cage as in claim 1 wherein said cage frames are provided with at least one bar guide collars- to receive a temporary lifting apparatus, said at least one bar guide collar comprised of an axially extending smooth bore sleeve or tube fastened rigidly to said three dimensional cage frames.

7. The pre-fabricated reinforcement cage as in claim 1 wherein said cage is installed vertically.

8. The pre-fabricated reinforcement cage as in claim 1 wherein said cage is installed horizontally.

9. The pre-fabricated reinforcement cage as in claim 1 wherein respective threads of each of said sleeves having said internal threading pattern are aligned with respective threads of adjacent sleeves of said plurality of axially extending sleeves.

10. The pre-fabricated reinforcement cage of claim 9, wherein said alignment of the internal threading of said internally threaded sleeves, such that predetermined locations of said internal threading along the longitudinal axis, is consistent between said adjacent internally threaded sleeves, is provided by the step of forming an alignment tool, said alignment tool being formed by attaching a thread alignment bar that is complimentary to the internally threaded sleeves to a fixed base having a planar surface that is substantially perpendicular to the longitudinal axis of the thread alignment bar, said fixed base having markings being made on said fixed base, wherein further said internally threaded sleeves being rotated onto said complimentary thread alignment bar until the base of each of said internally threaded sleeves comes into intimate contact with said surface of said fixed base, wherein further, said base of said internally threaded sleeves is in intimate contact with said surface of said fixed base, wherein further said markings are made on said internally threaded sleeves that are in alignment with said markings made on the fixed base;

wherein said aligning of said marks thus made on said internally threaded sleeves ensures substantial alignment of the internal threading of internally threaded sleeves along the longitudinal axis thereof.

11. A pre-fabricated reinforcement cage for longitudinally extending concrete reinforcing bars supporting and extending intimately through concrete aggregate material, comprising:

a plurality of longitudinally extending concrete reinforcing bars, said plurality of longitudinally extending concrete reinforcing bars having an external threading pattern over at least a portion of their length, said plurality of longitudinally extending concrete reinforcing bars being held axially aligned in place in an axis by at least two three dimensional cage frames spaced apart from each other, said three dimensional cage frames fabricated by welding together plates of said cage frame, said plates aligned in the direction of said longitudinally extending concrete reinforcing bars occupying a minimal sectional area of concrete element being reinforced, to minimize any impediment to the flow of concrete, insuring a lack of stress transmission discontinuities, said fabrication of said three dimensional cage frames imparting strength and stiffness to the reinforcing cage, using minimal material while affording economical fabrication of a wide variety of said three dimensional cage frames, to accommodate design determined size and spatial geometries, as well as strength requirements, said three dimensional cage frames including at least one circumferentially extending plate, said at least one circumferentially extending plate extending axially parallel to said axis of said plurality of longitudinally extending reinforcing bars, said three dimensional cage frames each having a plurality of axially extending sleeves, each said sleeve being rigidly fastened to said three dimensional cage frames, whereby said cage frame plates and axially aligned sleeves hold said plurality of longitudinally extending concrete reinforcing bars in an axially aligned parallel orientation while allowing said longitudinally extending concrete reinforcing bars to be rotated freely within said axially aligned sleeves.

12. The pre-fabricated reinforcement cage as in claim 11 wherein said at least one circumferentially extending plate of said cage frame is cylindrical.

13. The pre-fabricated reinforcement cage as in claim 11 wherein said at least one circumferentially extending plate of said cage frame is a plurality of plates forming at least one rectangle.

14. The pre-fabricated reinforcement cage as in claim 11 wherein said at least one circumferentially extending plate is a plurality of plates forming at least one polygon.

15. The pre-fabricated reinforcement cage as in claim 11 wherein said at least one circumferentially extending plate is a plurality of plates forming at least one square.

16. The pre-fabricated reinforcement cage as in claim 11 wherein said cage frames are provided with at least one bar guide collars to receive a temporary lifting apparatus, said at least one bar guide collar comprised of an axially extending smooth bore sleeve or tube fastened rigidly to said three dimensional cage frames.

17. The pre-fabricated reinforcement cage as in claim 11 wherein said cage is installed vertically.

18. The pre-fabricated reinforcement cage as in claim 11 wherein said cage is installed horizontally.

19. A pre-fabricated reinforcement cage as in claim 11 wherein said three dimensional cage frames each having a plurality of axially extending smooth bore sleeves, each said sleeve being rigidly fastened to said three dimensional cage frames, whereby said cage frame plates, said axially aligned smooth bore sleeves and at least one holding means hold said plurality of longitudinally extending concrete reinforcing bars in an axially aligned parallel orientation while allowing said longitudinally extending concrete reinforcing bars to be rotated freely within said axially aligned sleeves.

20. The pre-fabricated reinforcement cage as in claim 11 wherein said plurality of axially aligned sleeves of said three dimensional cage frames have a combination of at least one axially extending smooth bore sleeve having at least one holding means, and at least one axially extending internally threaded sleeve, said at least one threaded sleeve having an internal threading pattern that is complimentary to an external threading pattern of each of said plurality of longitudinally extending concrete reinforcing bars, whereby said cage frame plates, said axially aligned axially extending smooth bore sleeves, said axially aligned axially extending internally threaded sleeves, and said holding means hold said plurality of longitudinally extending concrete reinforcing bars in an axially aligned parallel orientation while allowing said longitudinally extending concrete reinforcing bars to be rotated freely within said axially aligned sleeves.

21. The pre-fabricated reinforcement cage as in claim 20 wherein said at least one axially extending threaded sleeve is a plurality of axially extending threaded sleeves, and said at least one axially extending smooth bore sleeves is a plurality of axially aligned smooth bore sleeves, each said sleeve being rigidly fastened to said three dimensional cage frames, whereby said cage frame plates, said axially aligned threaded sleeves and said axially aligned smooth bore sleeves and said holding means hold said plurality of longitudinally extending concrete reinforcing bars in an axially aligned parallel orientation while allowing said longitudinally extending concrete reinforcing bars to be rotated freely within said axially aligned sleeves.

22. The pre-fabricated reinforcement cage as in claim 11 wherein said plurality of axially extending sleeves are threaded axially aligned sleeves, each said sleeve having an internal threading pattern that is complimentary to an external threading pattern of each of said plurality of longitudinally extending concrete reinforcing bars.

23. The pre-fabricated reinforcement cage of claim 22, wherein said alignment of the internal threading of said internally threaded sleeves, such that predetermined locations of said internal threading along the longitudinal axis, is consistent between said adjacent internally threaded sleeves, is provided by the step of forming an alignment tool, said alignment tool being formed by attaching a thread alignment bar that is complimentary to the internally threaded sleeves to a fixed base having a planar surface that is substantially perpendicular to the longitudinal axis of the thread alignment bar, said fixed base having markings being made on said fixed base, wherein further said internally threaded sleeves being rotated onto said complimentary thread alignment bar until the base of each of said internally threaded sleeves comes into intimate contact with said surface of said fixed base, wherein further, said base of said internally threaded sleeves is in intimate contact with said surface of said fixed base, wherein further said markings are made on said internally threaded sleeves that are in alignment with said markings made on the fixed base;

wherein said aligning of said marks thus made on said internally threaded sleeves ensures substantial alignment of the internal threading of internally threaded sleeves along the longitudinal axis thereof.

24. The pre-fabricated reinforcement cage of claim 19 wherein said at least one holding means is a locking nut, each said locking nut having an internal threading pattern that is complimentary to an external threading pattern of each of said plurality of longitudinally extending concrete reinforcing bars, each said locking nut bearing against at least one end of each of said plurality of the axially extending smooth bore sleeves.

* * * * *